US007377893B2

(12) United States Patent
Herman et al.

(10) Patent No.: US 7,377,893 B2
(45) Date of Patent: May 27, 2008

(54) HERO-TURBINE CENTRIFUGE WITH FLOW-ISOLATED COLLECTION CHAMBER

(75) Inventors: Peter K. Herman, Cookeville, TN (US); Hendrik N. Amirkhanian, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 22 days.

(21) Appl. No.: 11/113,740

(22) Filed: Apr. 25, 2005

(65) Prior Publication Data

US 2006/0240965 A1 Oct. 26, 2006

(51) Int. Cl.
*B04B 9/06* (2006.01)

(52) U.S. Cl. ..... 494/49

(58) Field of Classification Search ..... 494/24, 494/36, 43, 49, 64, 65, 67, 83, 84, 901; 184/6.24; 210/168, 171, 232, 360.1, 380.1, 416.5
See application file for complete search history.

(56) References Cited

U.S. PATENT DOCUMENTS

| | | | | | |
|---|---|---|---|---|---|
| 3,432,091 | A * | 3/1969 | Beazley | 494/36 |
| 3,623,657 | A * | 11/1971 | Trump | 494/5 |
| 3,784,092 | A | 1/1974 | Gibson | |
| 3,791,576 | A | 2/1974 | Bazil | |
| 4,106,689 | A * | 8/1978 | Kozulla | 494/5 |
| 4,165,032 | A * | 8/1979 | Klingenberg | 494/49 |
| 4,221,323 | A * | 9/1980 | Courtot | 494/10 |
| 4,284,504 | A * | 8/1981 | Alexander et al. | 210/167.04 |
| 4,346,009 | A * | 8/1982 | Alexander et al. | 494/38 |
| 4,492,631 | A * | 1/1985 | Martin | 210/127 |
| 5,795,477 | A | 8/1998 | Herman et al. | 210/360.1 |
| 5,906,733 | A | 5/1999 | Purvey | |
| 6,017,300 | A | 1/2000 | Herman | 494/49 |
| 6,019,717 | A | 2/2000 | Herman | 494/49 |
| 6,454,694 | B1 * | 9/2002 | Herman et al. | 494/49 |
| 6,530,872 | B2 * | 3/2003 | Frehland et al. | 494/49 |
| 6,602,180 | B2 * | 8/2003 | Herman et al. | 494/75 |
| 2005/0187091 | A1 * | 8/2005 | South | 494/49 |
| 2006/0240965 | A1 * | 10/2006 | Herman et al. | 494/49 |

FOREIGN PATENT DOCUMENTS

| | | |
|---|---|---|
| GB | 2 297 505 | 8/1996 |
| JP | 50-11177 | 2/1975 |
| WO | 92/16303 | * 10/1992 |
| WO | 96/23589 | 8/1996 |

* cited by examiner

*Primary Examiner*—Charles E. Cooley
(74) *Attorney, Agent, or Firm*—Krieg DeVault LLP

(57) ABSTRACT

A centrifuge for the separation of particulate matter from a volume of fluid includes an outer housing, a rotational member extending through the outer housing, and a rotor assembled onto the rotational member for rotation relative to the rotational member and relative to the housing. The centrifuge is constructed and arranged to enable self-driven rotation by the exit flow of fluid through jet nozzle openings defined by the rotor. The rotational member includes a fluid passageway and an exit opening for delivering fluid to the rotor. The rotor includes a divider plate that separates the interior of the rotor into a collection chamber and a separate jet zone. The collection chamber has a single fluid entry location defined by the divider plate for processing a single batch of fluid at a time.

14 Claims, 19 Drawing Sheets

Replacement Sheet

HERO-TURBINE CENTRIFUGE WITH FLOW-ISOLATED COLLECTION CHAMBER

BACKGROUND OF THE INVENTION

The present invention generally relates to the separation of solid particles, such as soot, from a fluid, such as oil, by use of a centrifuge. More specifically, but not exclusively, one embodiment of the present invention relates to a centrifuge that includes two separate fluid paths in which one of the fluid paths travels through a particulate collection zone of the centrifuge and the other path bypasses the particulate collection zone to directly drive the centrifuge through jet nozzles. In a related embodiment, the collection chamber receives a single batch of fluid for processing without any flow-through of fluid during the processing of this single batch.

Diesel engines are designed with relatively sophisticated air and fuel filters (cleaners) in an effort to keep dirt and debris out of the engine. Even with these air and fuel cleaners, dirt and debris, including engine-generated wear debris will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try to address the concern over small particles, designers have gone to bypass filtering systems which filter a predefined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers substantial improvement over the use of only a full flow filter.

In high performance soot centrifuge (HPSC) designs, such as the one disclosed in U.S. Pat. No. 6,019,717 that was issued on Feb. 1, 2000 to Herman, which is incorporated by reference in its entirety, the inventors of the present invention have found that the collection rate of super-fine particulates, such as soot, increases by decreasing the flow rate passing through the rotor of the centrifuge. Traditional centrifuge theory predicts that reducing the flow rate in the rotor by half will result in a doubling of the single-pass collection efficiency of the centrifuge. Although the collection efficiency improves, since the flow rate is cut in half, the collection rate of particulates should remain unchanged. Graph 30, which is show in FIG. 1, graphically illustrates this predicted effect for super-fine particles, such as soot. As shown, graph 30 includes a flow rate axis 32 and a collection rate axis 33. Prediction line 35 in graph 30 illustrates the prediction that flow rate through the centrifuge has no effect on the collection rate. However, the inventors of the present invention have discovered that this theory does not appear to hold up in super-fine particulate regime where collection efficiencies are typically well under 0.5% on a single pass basis. As shown with actual line 36, the collection rate of the super-fine particles increases as the flow rate is decreased. It is theorized that the collection rate is improved at the lower flow rate though reduced re-entrainment of particulates in the fluid. The reduced flow rate diminishes fluid eddies and flow passing in close proximity to the collected particles (sludge) in the sludge collection zone of the centrifuge, which in turn reduces the amount of re-entrainment of the collected particles. The HPSC design allows for the freedom to reduce the rotor "through flow" rate without penalizing rotor speed. In the HPSC design, the fluid flow driving upon an external Pelton turbine is independent from the rotor flow rate so that the flow rates can be independently adjusted.

Unfortunately, in the lower cost and widely used hero-turbine centrifuge designs, (such as the ones disclosed in U.S. Pat. No. 5,795,477 that was issued on Aug. 18, 1998 to Herman et al. which is incorporated by reference in its entirety) simply reducing the rotor through flow to take advantage of this effect, does not work. In the hero-type centrifuges, a single flow path is used for both separation of particulates from the fluid and driving the centrifuge. Reducing the flow rate in the rotor reduces rotor speed because the rotation driving power is proportional to the rotor flow rate. One type of solution, such as disclosed in U.S. Pat. Nos. 3,784,092 and 5,906,733, is to provide two separate fluid sources, one for driving the centrifuge and the other for separation. However, using the two separate fluid sources in these designs increases the complexity and expense of the centrifuge. Furthermore, retrofitting such types of centrifuges to pre-existing systems is costly because additional piping needs to be installed.

A further embodiment of the present invention configures the centrifuge and rotor such that the incoming fluid flow follows a flow pattern or path that first fills the rotor collection chamber with a single batch or charge of fluid (oil) that continues to be cleaned until shut down and then drains. Once the collection chamber is filled, the incoming flow is routed to the jet nozzle openings for self-driven rotor rotation, without any continuous flow-through of fluid through the collection chamber or collection zone.

SUMMARY OF THE INVENTION

A centrifuge for separating particulate matter out of a fluid volume according to one embodiment of the present invention comprises a housing, a rotational member extending through the housing, a rotor assembled onto the rotational member and positioned within the housing, the centrifuge being constructed and arranged to enable the self-driven rotation of the rotor by the exit flow of fluid from the rotor, the rotational member defining a fluid passageway and an exit opening from the rotational member, the rotor including a divider plate separating the rotor into a collection chamber and a jet zone and the collection chamber having a single fluid entry location defined by the divider plate.

One object of the present invention is to provide an improved centrifuge.

Related objects and advantages of the present invention will be apparent from the following description.

DESCRIPTION OF THE PREFERRED EMBODIMENTS

Figure 1:
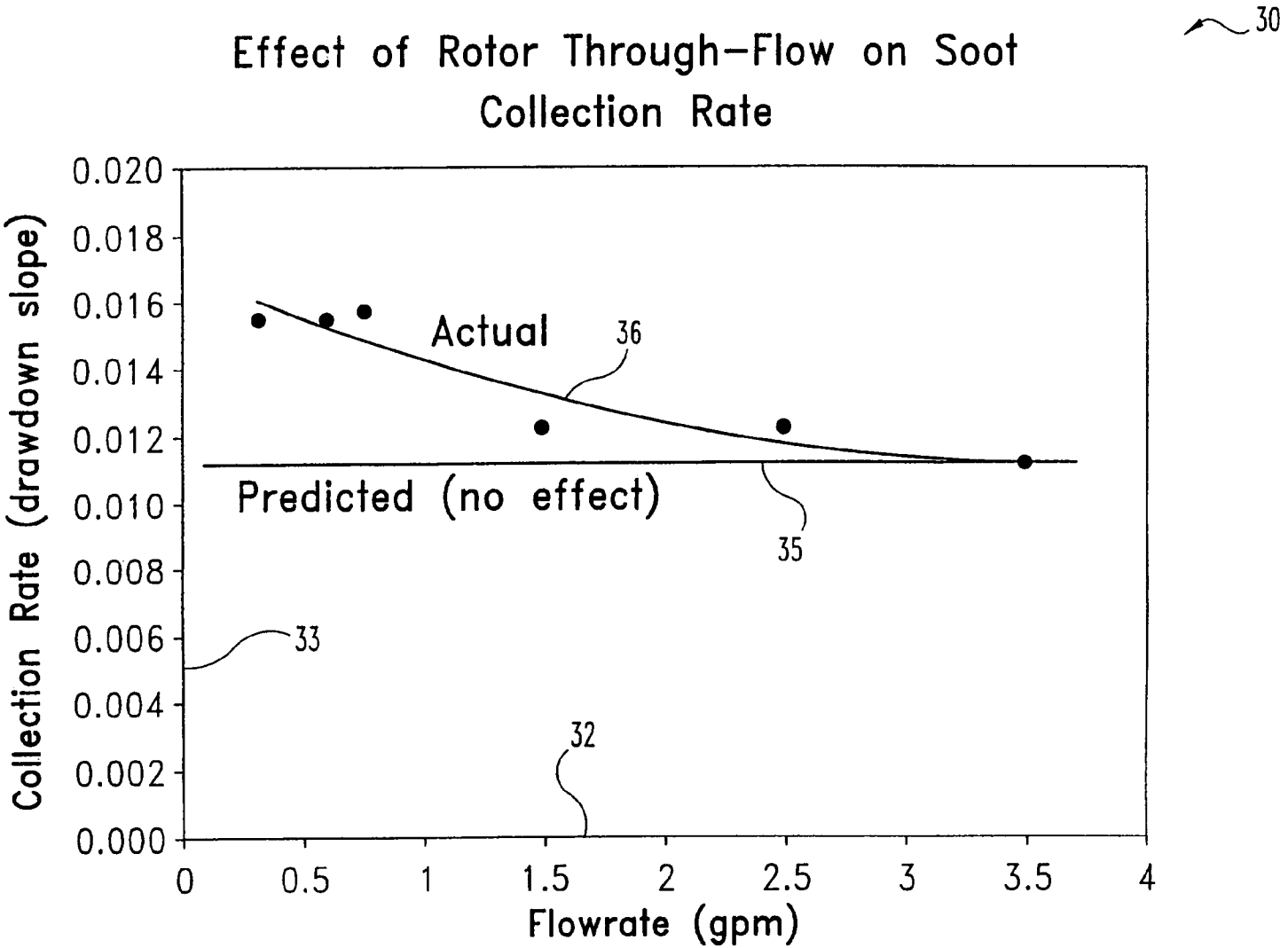
FIG. 1 is a graph illustrating the effect of rotor flow rate on collection rates for super-fine particles.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it should be apparent to those skilled in the art that some of the features which are not relevant to the invention may not be shown for the sake of clarity.

The fluid flow in a "free-jet" hero-turbine centrifuge rotor according to the present invention, which is either a "take apart" or a "disposable" design style, is modified to reduce the volumetric flow rate passing through the particulate collection zone (at which sludge, soot and other particulates are collected) without penalizing the rotor speed. The present invention accomplishes this by dividing the flow rate into two separate flow paths at the entrance of the rotor or after entering the rotor. The flow can be split at the entrance, for example, by utilizing two holes drilled in the rotor shaft that are separated by a baffle. The fluid can be split after entering the rotor by employing a seal between the shaft and the centrifuge hub, for example. In this "split-flow" centrifuge configuration, approximately 70% of the flow rate can be bypassed to the drive jets, while approximately 30% of the flow can be routed through the sludge collection zone in one embodiment. In other embodiments, this flow split (bypass flow rate to separation flow rate) can range anywhere from about a 1:1 ratio to about a 10:1 ratio. In the 1:1 flow split ratio, 50% of the fluid flow bypasses the sludge collection zone and 50% of the fluid flows through the sludge collection zone. In the 10:1 flow split ratio, approximately 90% of the fluid flow bypasses the sludge collection zone, while only 10% of the fluid flows through the sludge collection zone.

Reducing flow rate in the sludge collection zone improves the collection and especially the retention of super-fine particulates, such as soot, that is dispersed in a fluid. It should be noted, however, that this improvement in collection rate of super-fine particulates will come at the cost of decreased collection rate of larger particulates that are approximately greater than 3 microns in size. This is caused by the "100% efficiency constraint". The collection efficiency of the larger particulates cannot be increased beyond 100%. Therefore, decreasing the rotor flow rate results in reduced collection rate for the larger particulates due to the reduced through-put along with a single pass efficiency that cannot be above 100%.

The present invention described below attempts to extend the benefits of low rotor flow rate to the lower cost hero-turbine style centrifuges. In this type of centrifuge, all of the flow passing into the rotor is jetted out the turbine driving nozzles to achieve the highest possible rotational speed. Achieving this reduced through flow rate without reducing rotor speed requires a novel and non-obvious internal split path rotor flow in which some of the fluid flow passes through the sludge collection zone of the rotor while the larger portion of the fluid passes directly to the drive jets.

As described in more detail below, this can be achieved by using two general methods, a pre-rotor split method and a post-rotor split method. In the pre-rotor split method, two separate radially drilled ports are formed in the shaft and a ring shaped baffle is provided on the centrifuge hub between the two ports to ensure that fluid from each of the ports stays in the correct flow path. One of the fluid paths passes through the sludge collection zone before being discharged out drive jets and the other fluid path passes directly to the drive jets. In the post-rotor split method, a number of different techniques can be used to create separate flow paths in the rotor. In one technique, a baffle is used to control the rotor through flow rate such that the desired flow split between the collection zone and driving flow rate is achieved. In one form, a clearance space is formed between a drive shaft and an inwardly projecting ring shaped baffle so as to control the flow rate to the sludge collection zone. In another form, axial flow notches are molded into a lower end of the hub. The ratio between the areas of the two notches and clearance space can be adjusted to achieve the desired flow split. In an alternate approach, the opening sizes of orifices along each flow path are proportionally sized to achieve the desired flow rate.

Figure 2:
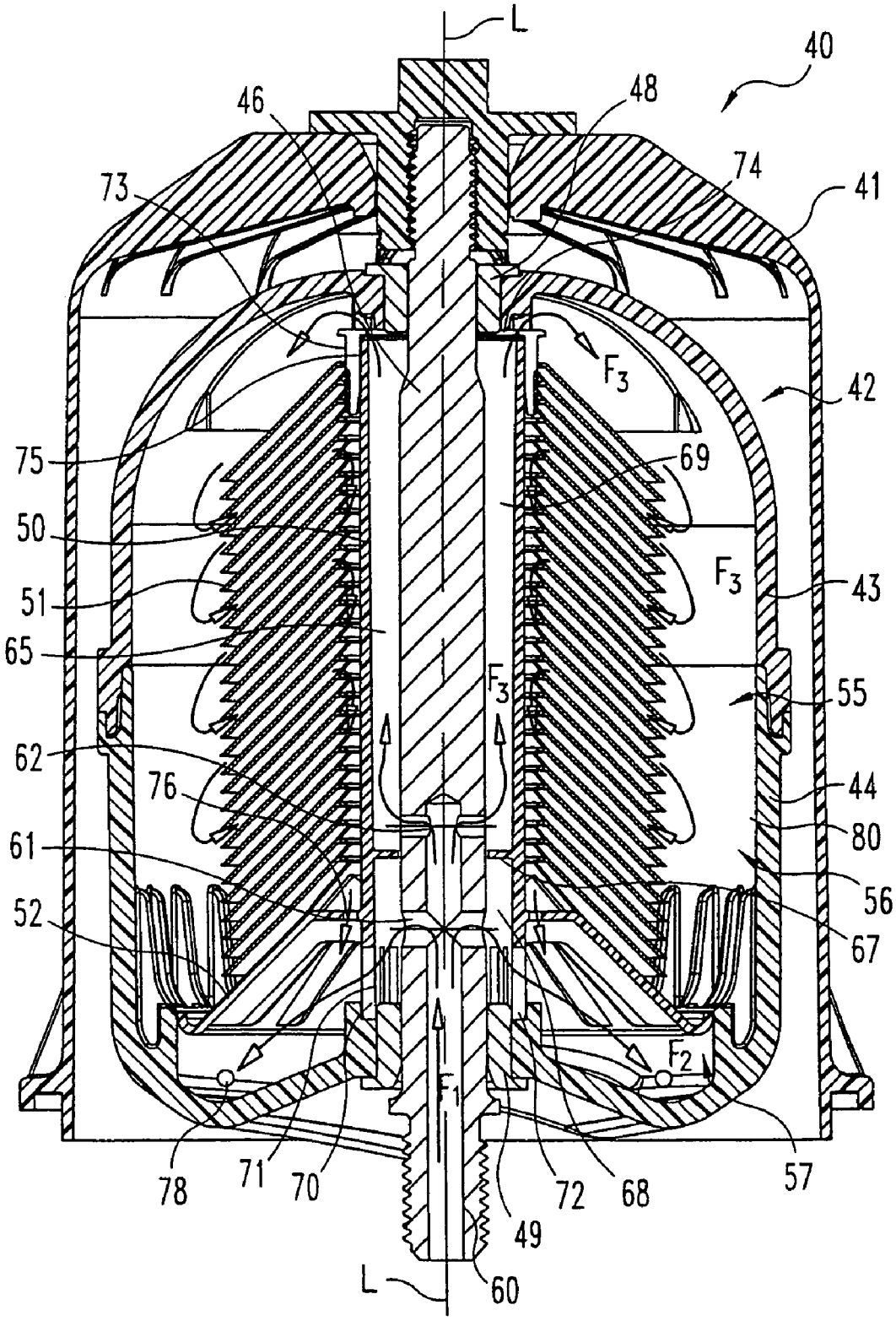
FIG. 2 is a front elevational view in full section of a self-driven centrifuge according to one embodiment of the present invention.

Referring to FIG. 2, there is illustrated a centrifuge 40 according to one embodiment of the present invention. Centrifuge 40 includes as some of its primary components a bell housing 41, rotor assembly 42 that includes upper 43 and lower 44 rotor shells, a rotor shaft 46, an upper bearing 48, a lower bearing 49, a center tube (hub) 50, a cone stack assembly 51, and a bottom divider plate 52.

Upper bearing 48 and lower bearing 49 are respectively used to rotationally mount the upper rotor shell 43 and lower rotor shell 44 to the shaft 46. The upper rotor shell 43 and lower rotor shell 44 together define an inner cavity 55. The bottom divider plate 52 subdivides cavity 55 into a sludge or particulate collection cavity portion (zone) 56 and a fluid discharge (drive) cavity portion 57. In the illustrated embodiment, the sludge collection portion 56 has the cone stack 51 contained therein. Although the present invention will be described for use with cone stack assemblies, it should be appreciated that the present invention can be adapted for use in other types of centrifuges, such as conventional or spiral vane types.

In the illustrated embodiment, the rotor shaft 46 is continuous and extends between the upper bearing 48 and the lower bearing 49. As should be appreciated that instead of being continuous, the rotor shaft 46 can be discontinuous so as to include two separate shaft portions. In this discontinuous form, an open space is defined between the shaft portions such that one of the shaft portions supports the upper bearing 48 and the other supports the lower bearing 49. In the illustrated embodiment, the rotor shaft 46 has a single fluid supply passage 60 defined therein for supplying fluid to the centrifuge 40. As shown in FIG. 2, the shaft 46 further has a pair of lower bypass ports 61 and a pair of upper fluid supply (separation) ports 62, both pairs of which are in fluid communication with the fluid supply passage 60. With each port pair, the ports 61, 62 for each pair are radially disposed at 90 degrees with respect to one another around longitudinal axis L of the shaft 46. It should be appreciated, however, that the supply ports 61, 62 can be oriented at other angles relative to longitudinal axis L of the shaft 46. Both the shaft 46 and center tube 50 define a center tube cavity 65. Inside cavity 65, the center tube 50 has an integrally formed seal ring baffle 67 positioned between bypass ports 61 and supply ports 62. It should be appreciated that, in an alternate form, the seal ring baffle 67 can instead be a separate component or attached to the shaft 46. The seal ring baffle 67 subdivides the center tube cavity 65 into a bypass cavity portion 68 and a separation cavity portion 69. At one end 70 of the center tube 50 proximal to the bypass cavity portion 68, the center tube 50 has a plurality of axial notches 71 defined therein. As should be understood, differently shaped or other types of openings besides the axial notches 71 can be defined in the center tube 50. As shown, the notched end 70 of tube 50 is received in an annular cavity 72 formed in the lower rotor shell 44. The cone stack assembly 51 has an end cap or spool 73 with a plurality of radially disposed separation openings 74 defined therein. Spool 73 is received around the other end 74 of the center tube 50. The divider plate 52 has a plurality of divider plate passages 76 defined around the center tube 50 so as to provide a passageway between the two cavities 56, 57. In the illustrated embodiment, the divider plate 52 is integrally formed with the center tube 50. It should be appreciated that instead having an integral divider plate 52 with a plurality of divider passages 76, a gap can be formed between the divider plate 52 and the center tube 50 so as to form an annular passageway. As illustrated in FIG. 2, the lower rotor shell 44 has jet flow orifices (nozzles) 78 defined therein. The jet flow orifices 78 are used to drive the centrifuge 40.

During operation, fluid, such as oil, is supplied by fluid supply passage 60 to the centrifuge 40, which is indicated by flow path F1. The fluid is then split into two distinct flow paths, bypass flow path F2 and separation flow path F3. As shown, fluid traveling along bypass flow path F2 is discharged from bypass ports 61 into the bypass cavity portion 68 of the center tube 50. The fluid traveling along bypass flow path F2 then travels through notches 71 into drive cavity 57 and is discharged from nozzles 78 to drive (rotate) the rotor assembly 42. The fluid traveling along separation flow path F3 has suspended particulates first removed before being discharged out nozzles 78. As depicted, fluid traveling along separation flow path F3 is discharged from supply ports 62 into fluid supply cavity portion 69. The seal ring baffle 67 seals cavity portion 68 from cavity portion 69 so as to minimize leakage of fluid between the flow paths F2 and F3. From fluid cavity supply portion 69, the fluid exits separation openings 74 into sludge collection cavity 56. The particulates settle against the inner walls 80 of the housing and are collected in the form of sludge. From the sludge collection cavity 56, the fluid is discharged out divider passages 76. This fluid from the separation flow path F3 along with the bypass fluid from the bypass flow path F2 is then discharged out jet flow orifices 78 in order to drive the rotor assembly 42 such that the rotor 42 can maintain an optimal rotational speed.

Figure 3:
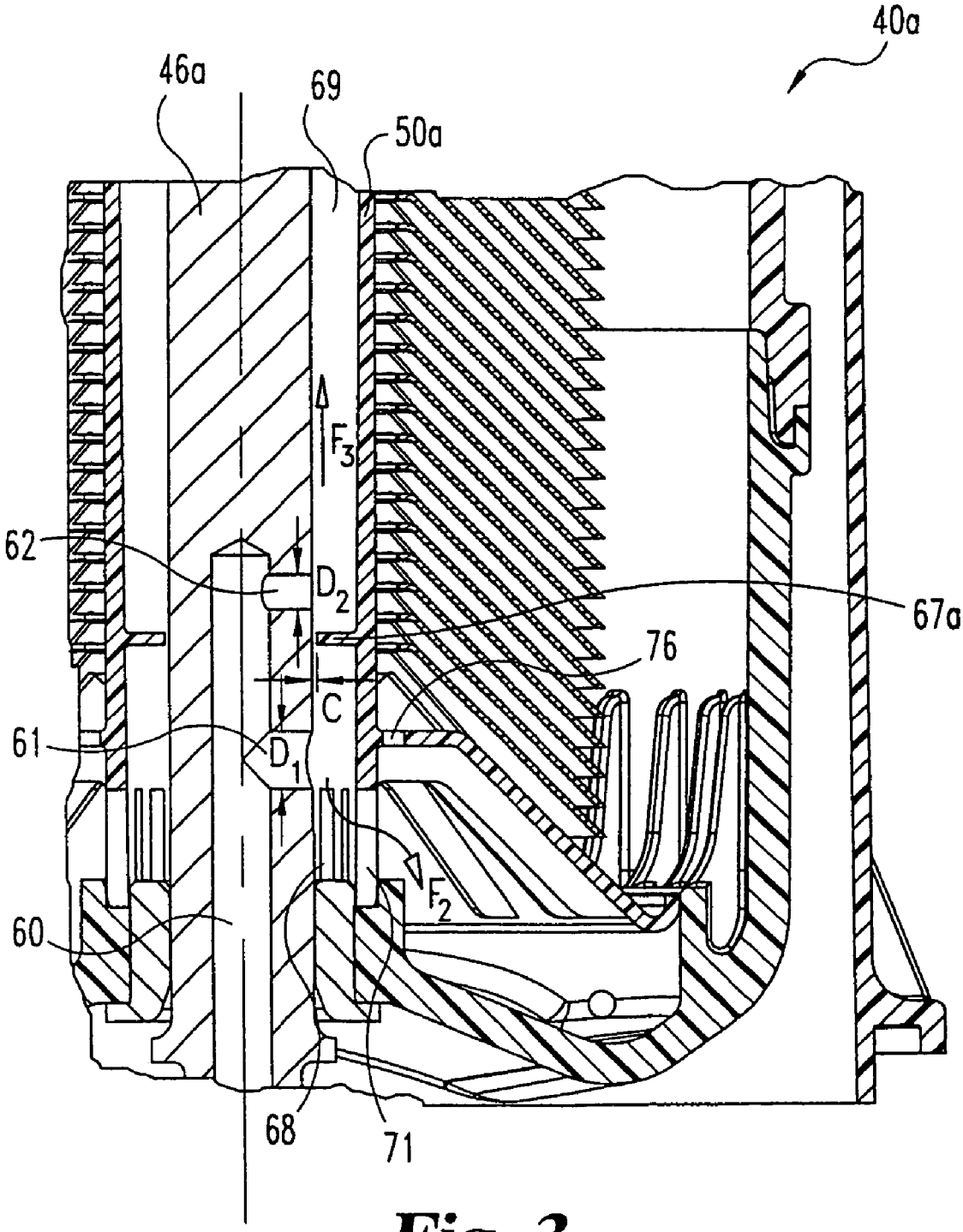
FIG. 3 is a partial, front elevational view in full section of a self-driven centrifuge according to another embodiment of the present invention.

A centrifuge 40*a* according to another embodiment of the present invention is illustrated in FIG. 3. Instead of the "full cross-drilled ports style" configuration as shown in the FIG. 2 embodiment, shaft 46*a* in this embodiment uses a single port design. As shown, instead of using pairs of ports 61 and 62, only a single port of each type is defined in the shaft 46*a*. The bypass port 61 has a diameter D1 and the supply port 62 has a diameter D2. For the illustrated embodiment, computational fluid dynamic analysis (CFD) modeling has shown in the case of the single port design of FIG. 3, a 3 mm supply port diameter D2 along with a 5 mm bypass port diameter D1 provides a desired 2:1 flow split ratio such that approximately 67% of the fluid bypasses the sludge collection zone cavity 56 and approximately 33% of the fluid flows through the sludge collection cavity 56. In the FIG. 2 embodiment that uses the full drill design ports to achieve a desired 2:1 flow split ratio, the diameter D2 of supply port 62 must be smaller, at 2.4 mm, due to a reduction in back pressure along with the inertial tendency of the fluid to keep moving upwards in passage 60. In both of these size configurations, pressure drop across either of the configurations is minimal (approximately less than 5 psid).

It was also discovered that radial clearance gap C (FIG. 3) between the baffle 67, 67*a* of the center tube 50, 50*a* and the shaft 46, 46*a* was critical in order to minimize cross leakage between the two flow paths F2, F3. It was found that a 0.5 mm clearance gap C between the baffle 67, 67*a* and the shaft 46, 46*a* created excessive leakage which negated the desired flow splits between flows F2 and F3. The 0.5 mm clearance C negated the desired flow split regardless on how the proportional sizes of the two ports 61 and 62 were adjusted.

Figure 4:
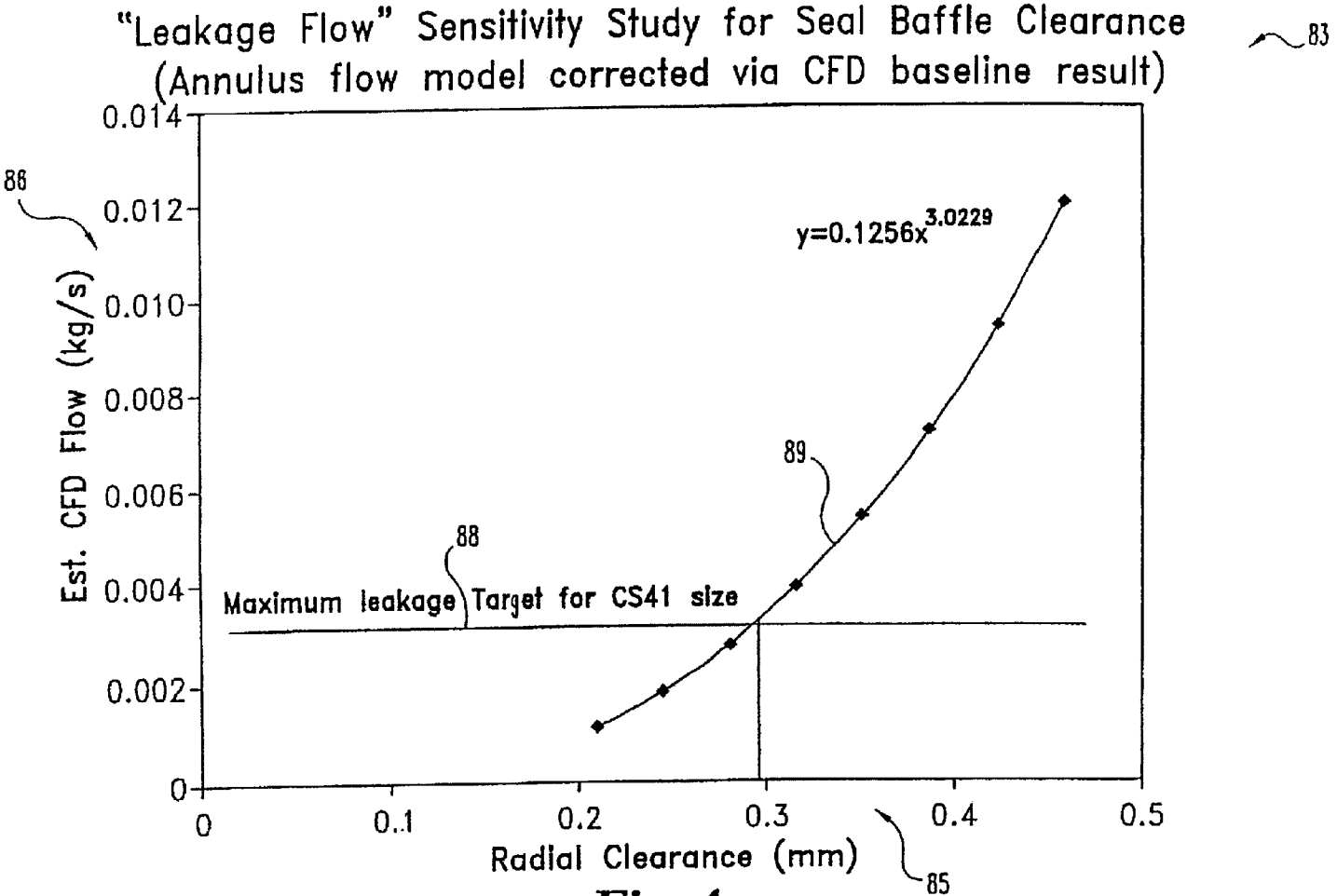
FIG. 4 is a graph illustrating the effect of baffle seal clearance on flow path leakage in the FIG. 3 centrifuge.

Further analysis showed that the radial seal ring clearance C should not exceed 0.3 mm in order to control leakage to a tolerable level. As shown in leakage study graph 83 in FIG. 4, the estimated leakage was calculated for differing radial clearances C. Graph 83 includes a radial clearance axis 85 and an estimated CFD leakage flow axis 86. The maximum target leakage of approximately 10% is shown by line 88 and the calculated values are shown by line 89. As depicted in the graph 83, the 0.3 mm clearance C keeps leakage to a tolerable level.

Figure 5:
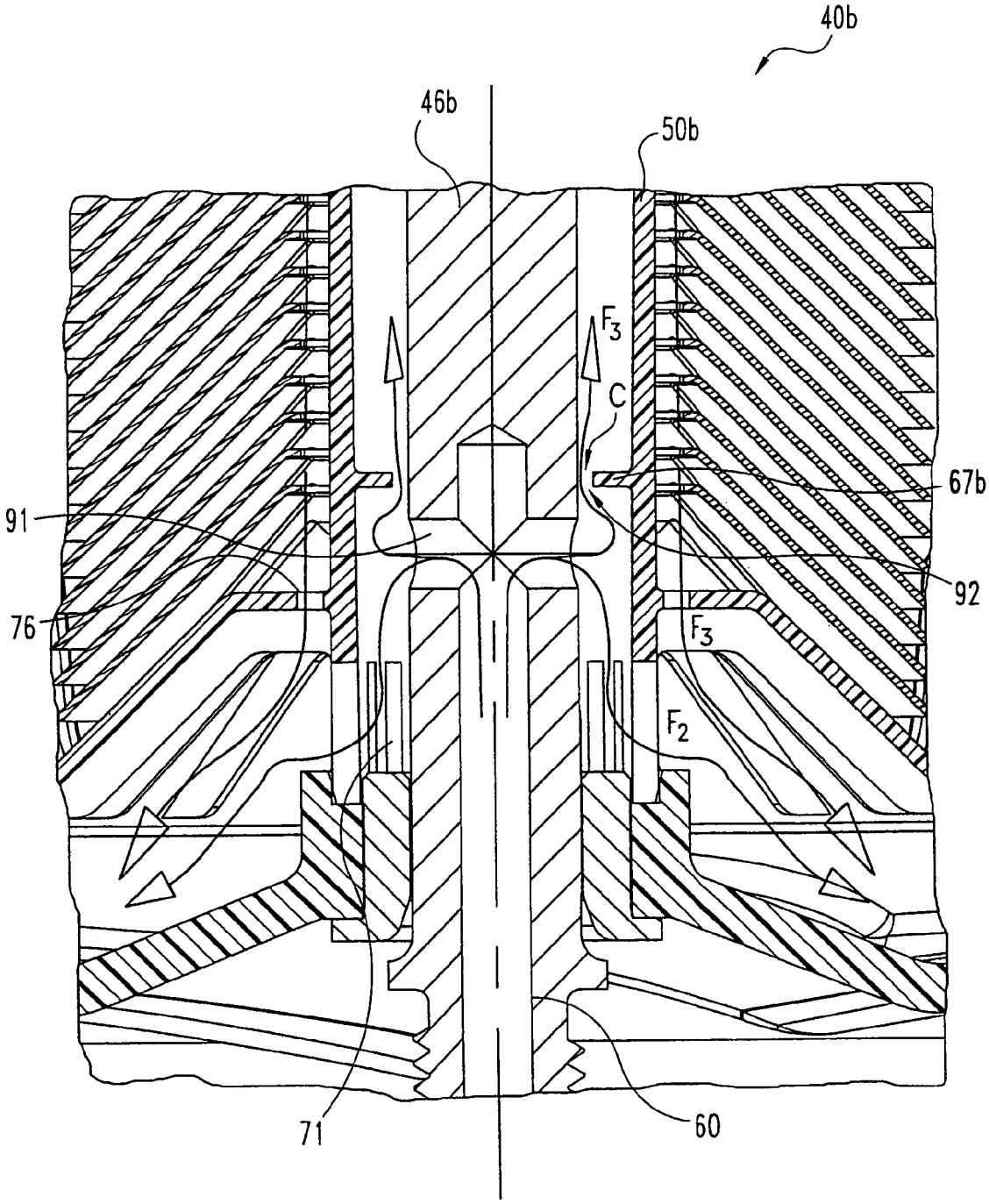
FIG. 5 is a partial, front elevational view in full section of a self-driven centrifuge with a single pair of fluid supply ports according to a further embodiment of the present invention.

A centrifuge 40*b* according to another embodiment of the present invention is illustrated in FIG. 5. As depicted, shaft 46*b* has a single pair of fluid supply ports 91 that supply fluid for both fluid path F2 and F3. The baffle seal ring 67*b* in this embodiment has clearance C from the shaft 46*b* so as to form an annular throttle passage 92. The clearance C between the seal ring 67*b* and shaft 46*b* is adjusted to throttle the fluid such that the desired flow split ratio is maintained. The baffle 67*b* is provided downstream from port 91 with respect to flow path F3 so as to control the amount of fluid flowing along flow path F3. As should be appreciated, in an alternate form a single port 91 can be provided in order to supply fluid to the centrifuge 40*b*. Alternatively, more than two fluid ports 91 can also be used to supply fluid to the centrifuge 40*b*.

Figure 6:
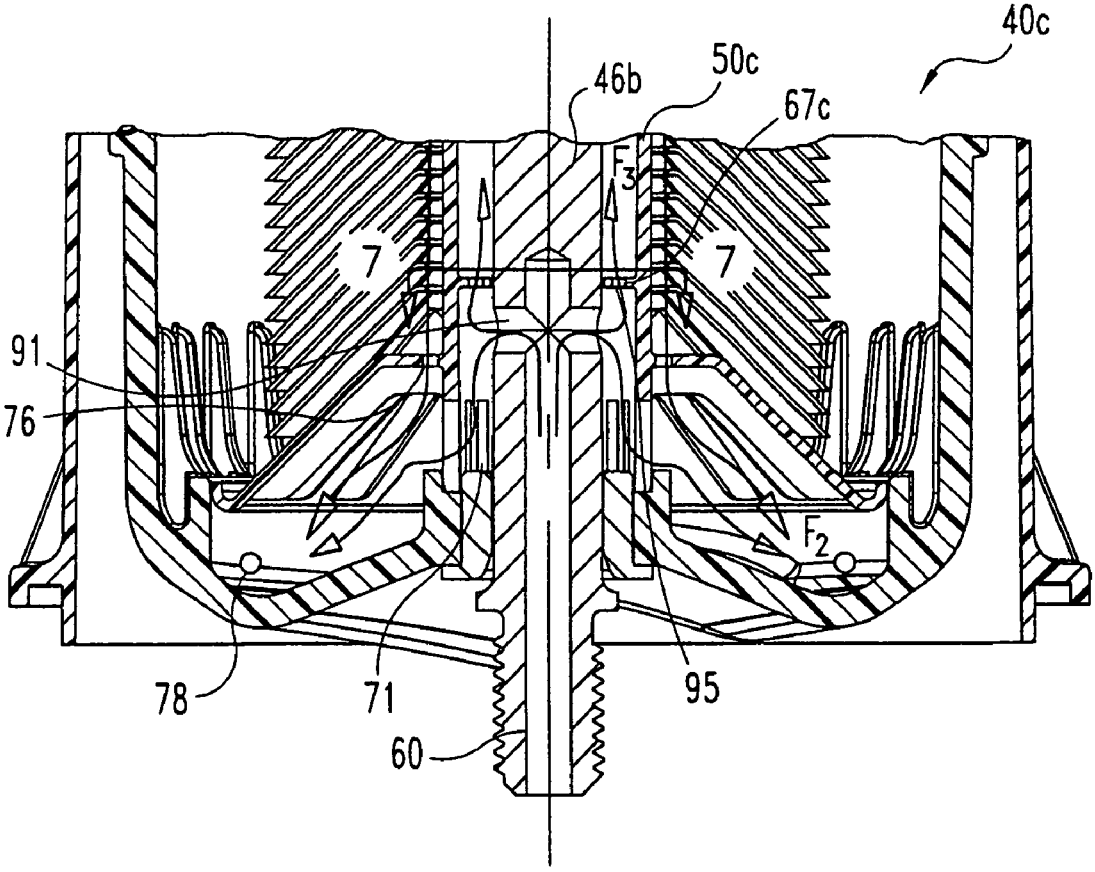
FIG. 6 is a partial, front elevational view in full section of a self-driven centrifuge with a modified baffle according to another embodiment of the present invention.
Figure 7:
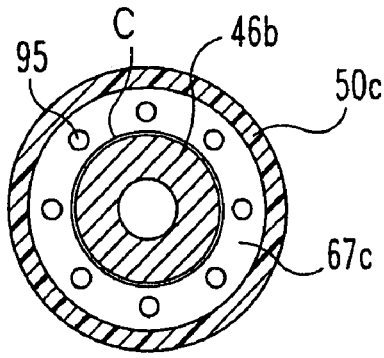
FIG. 7 is a partial, top-plan section view of the FIG. 6 centrifuge as viewed along line 7-7, with the cones, rotor shell and housing removed for added clarity.

A centrifuge 40*c* according to a further embodiment of the present invention is illustrated in FIGS. 6-7. As depicted in FIG. 6, the shaft 46*b* has a single pair of fluid ports 91 that supply fluid to the centrifuge 40*c*. As compared to the FIG. 5 centrifuge design 40*b* in which annular passage 92 was used to throttle fluid flow along separation flow path F3, center tube 50*c* in the FIG. 6 embodiment has a baffle 67*c* with a plurality of radially disposed flow openings 95 through which the fluid travels along flow path F3. FIG. 7 illustrates a cross-sectional view of the centrifuge 40*c*, but only shows the center tube 50*c*, shaft 46*b* and baffle 67*c* for the sake of clarity. As shown, flow openings 95 are radially disposed about the shaft 46*b*. The gap C between the shaft 46*b* and baffle 67*c* is minimized such that the fluid predominantly flows through openings 95. The number, size, and shape of openings 95 can be adjusted in order to provide the desired flow split ratio.

Figure 8:
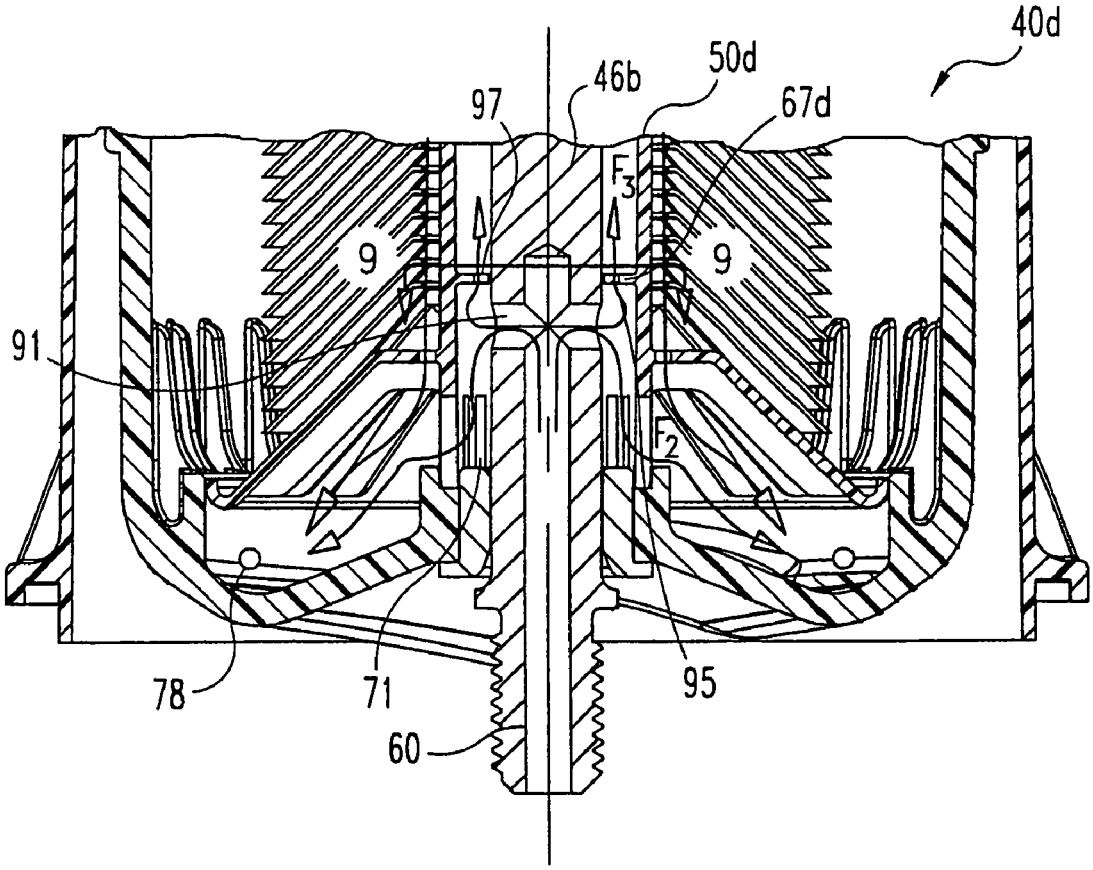
FIG. 8 is a partial, front elevational view in full section of a self-driven centrifuge with a serrated baffle according to another embodiment of the present invention.
Figure 9:
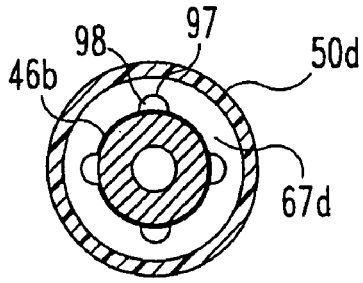
FIG. 9 is a partial, top-plan section view of the FIG. 8 centrifuge as viewed along line 9-9, with the cones, rotor shell and housing removed for added clarity.

A centrifuge 40*d* according to still yet another embodiment of the present invention is illustrated in FIGS. 8-9. As depicted in FIG. 8, centrifuge 40*d* includes shaft 46*b* positioned inside center tube 50*d*. As shown in greater detail in FIG. 9, the center tube 50*d* has a seal ring baffle 67*d* that includes a plurality of radially disposed serrations 97. The shaft 46*b* and the serrations 97 define flow openings 98 for fluid flow path F3. As illustrated in FIG. 9, the serrations 97 are radially disposed around the shaft 46*b*. The serrations 97 are sized and configured to provide the desired flow split ratio in the centrifuge 40*d*, such as from a 1:1 to 10:1 ratio.

Figure 10:
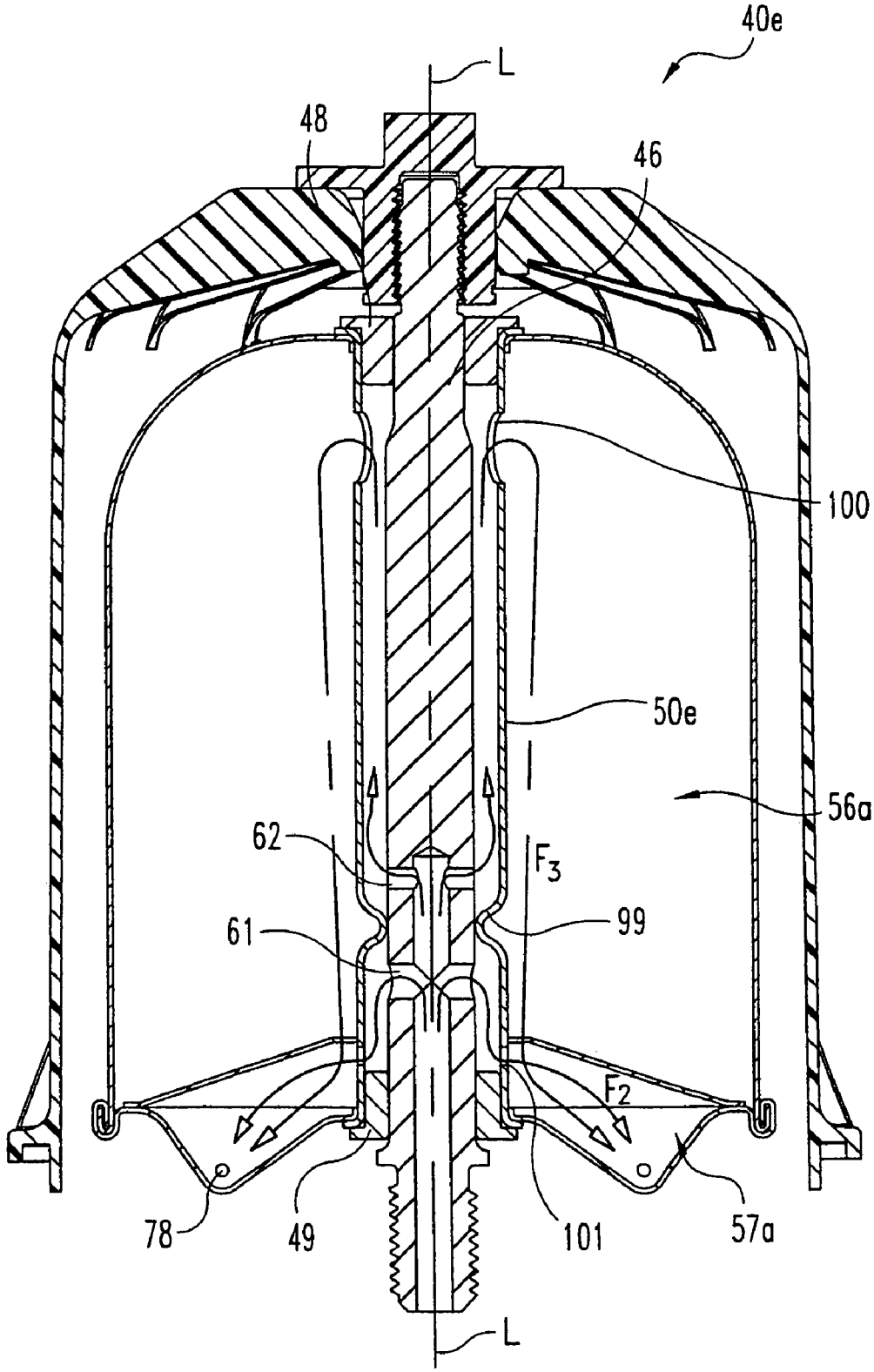
FIG. 10 is a front elevational view in full section of a self-driven centrifuge with a bent ridge baffle according to a further embodiment of the present invention.
Figure 11:
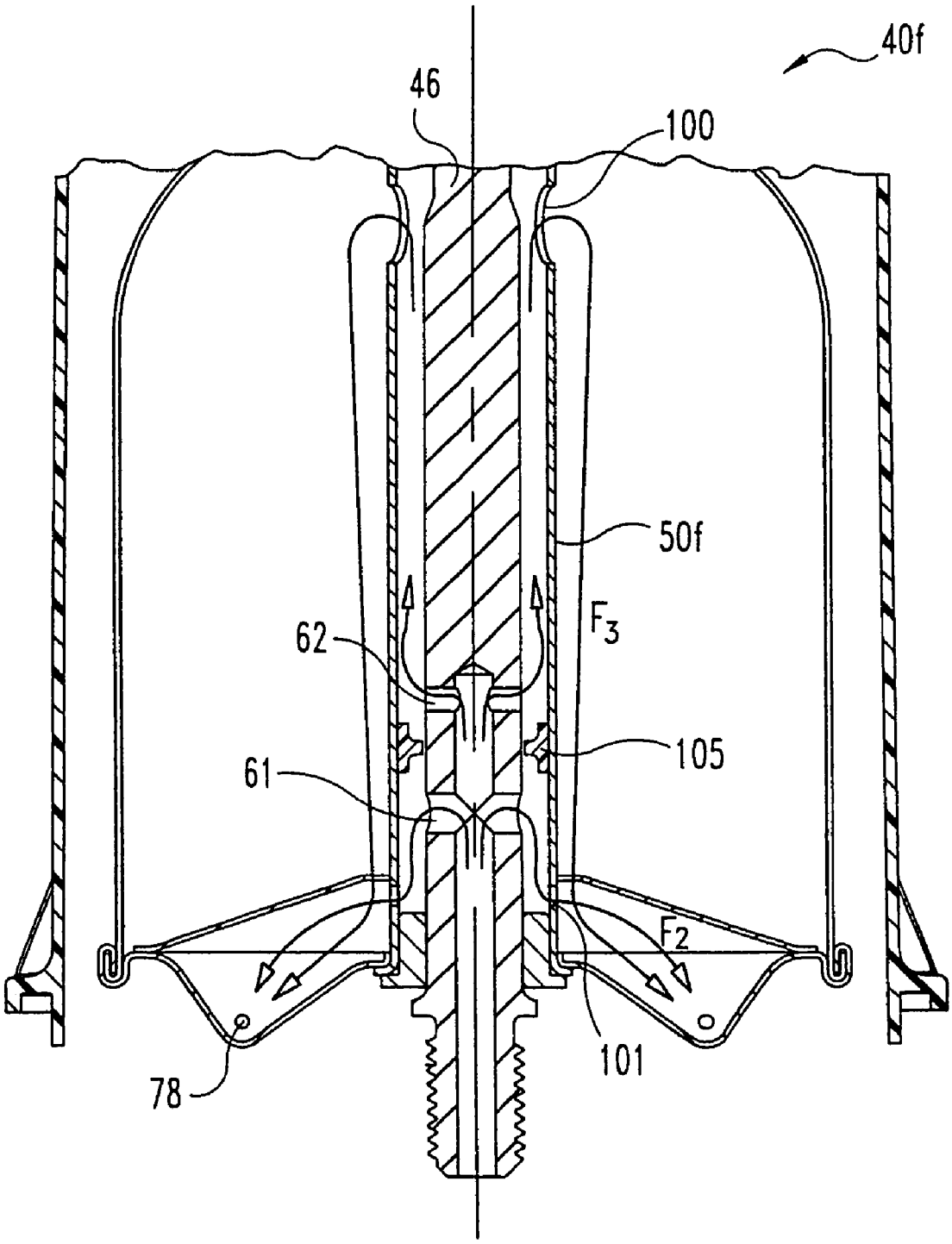
FIG. 11 is a partial, front elevational view in full section of a self-driven centrifuge with an elastic seal ring baffle according to another embodiment of the present invention.

It should be appreciated that "conventional" disposable rotor designs that do not incorporate efficiency enhancement devices, such as cone stacks or spiral vanes, and "take apart" rotor designs with metallic components that are designed to be cleaned and re-used instead of discarded can also incorporate the flow direction concepts according to the present invention. An example of one such modified centrifuge 40*e* is shown in FIG. 10. Centrifuge 40*e* includes a dual inlet shaft 46 that includes bypass 61 and separation 62 ports. The center tube 50*e* in the illustrated embodiment includes a formed (bent) ridge 99 that acts as a baffle to minimize leakage between the two flow paths F2, F3. An outlet opening 100 for flow path F3 is defined in the upper portion of the center tube 50*e*, which is proximal separation cavity 56*a*. A bypass opening 101 is defined in the lower portion of center tube 50*e*, proximal cavity 57*a* through which fluid can flow along bypass flow path F2. In another embodiment, which is shown in FIG. 11, an insertable, elastic seal ring 105 is placed inside center tube 50*e* between ports 61 and 62 so as to act as a baffle.

Figure 12:
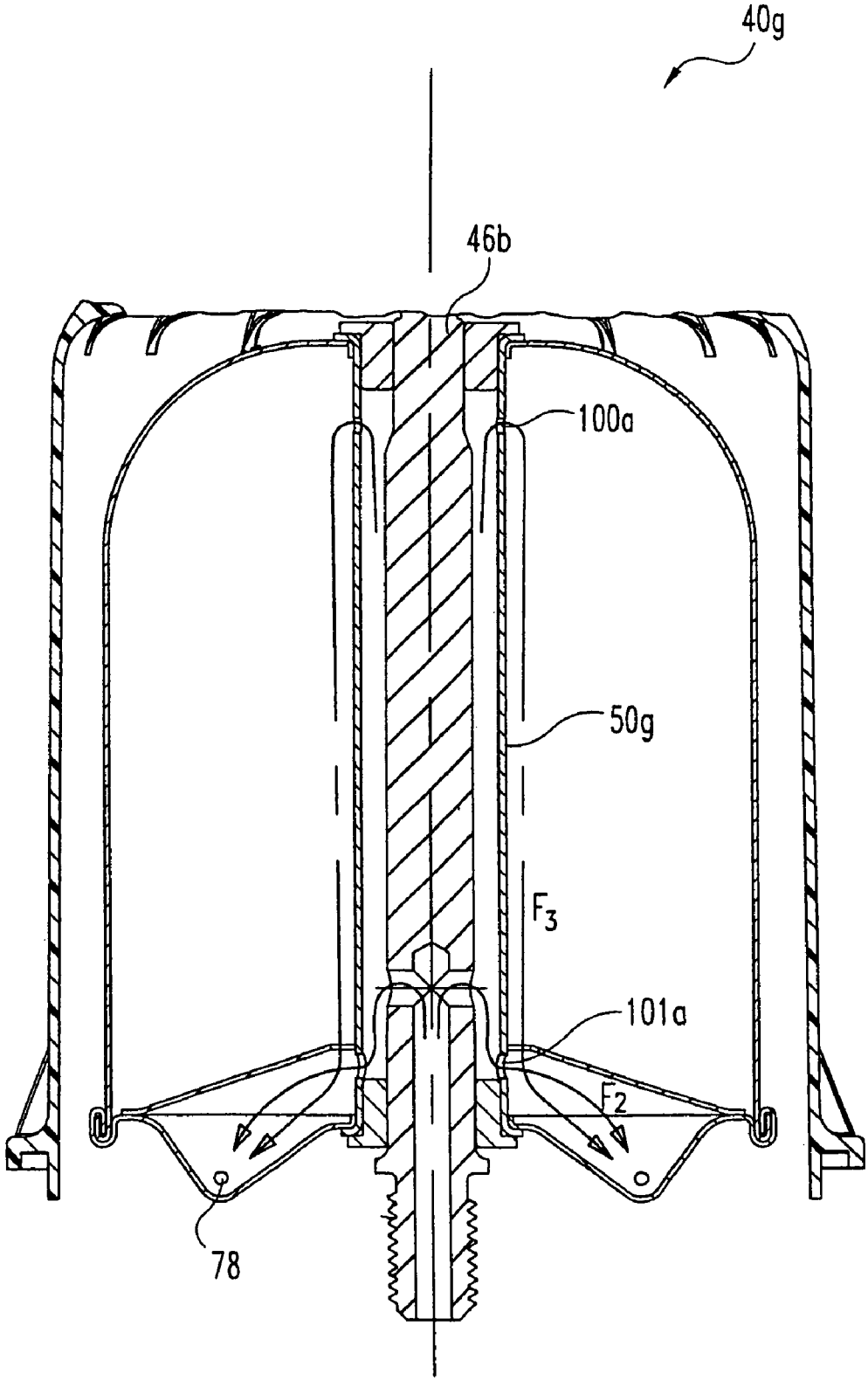
FIG. 12 is a partial, front elevational view in full section of a self driven centrifuge according to still yet another embodiment of the present invention.

In still yet another embodiment, as shown in FIG. 12, instead of using a baffle to direct flow in centrifuge 40*g*, the sizes of openings 100*a* and 101*a* in center tube 50*g* are adjusted to achieve the desired flow split. The openings 100*a* and 101*a* can be proportionally sized such that the desired fluid split ratios for the flow paths F2, F3 can be achieved. Assuming the pressure at openings 100*a* and 101*a* are the same, then the total size of each of the openings 100*a*, 101*a* will restrict flow proportionally to achieve the desired flow split ratio. For example, to have a desired 1:1 flow split ratio of flow, then the total size of each opening 100*a*, 101*a* should be the same. This concept can be used during the design phase to approximate the desired opening sizes required to achieve a desired flow split ratio. As the pressure differential between the openings 100*a*, 101*a* increases, such a design concept is less applicable, and modeling and/or testing must be used to determine the proportional sizing of the openings 100*a*, 101*a* in order to achieve the desired flow split ratio.

Figure 13:
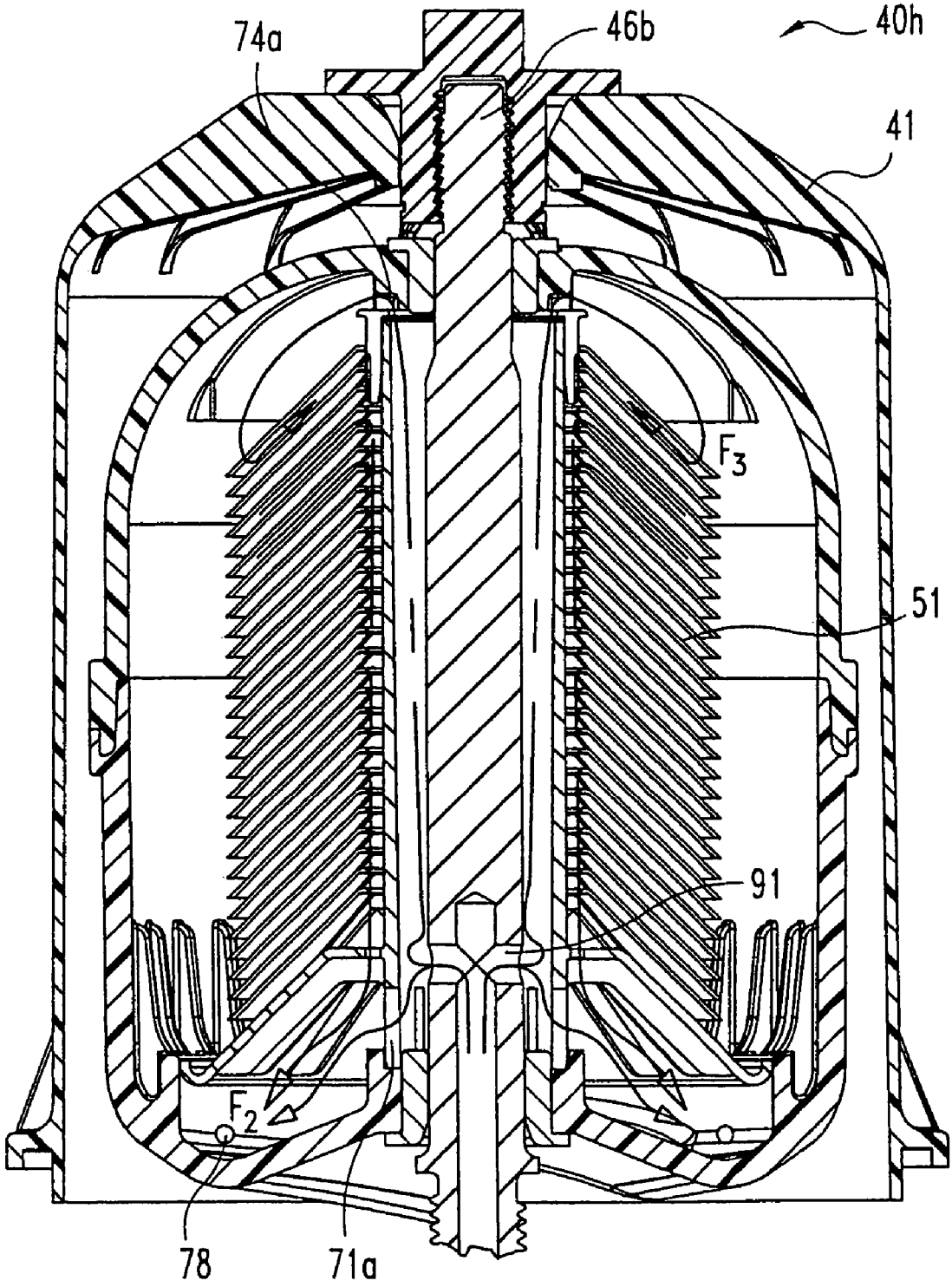
FIG. 13 is a front elevational view, in full section, of a self driven centrifuge according to a further embodiment of the present invention.

A centrifuge 40*h* according to another embodiment of the present invention is illustrated in FIG. 13. In this type of centrifuge, no modifications to the previously installed rotor shaft 46*b* needs to be made and minimal tooling changes need to be made to an existing disposable rotor design (Fleetguard CS41 series, which is now in production). In the illustrated embodiment, the sizes of openings 74*a* and 71*a* are adjusted in order to create the desired flow split ratio. As discussed above, properly sizing and numbering these openings can provide the proper choking of the flow passages so as to throttle the fluid flow in order to provide the desired flow split ratio.

Figure 14:
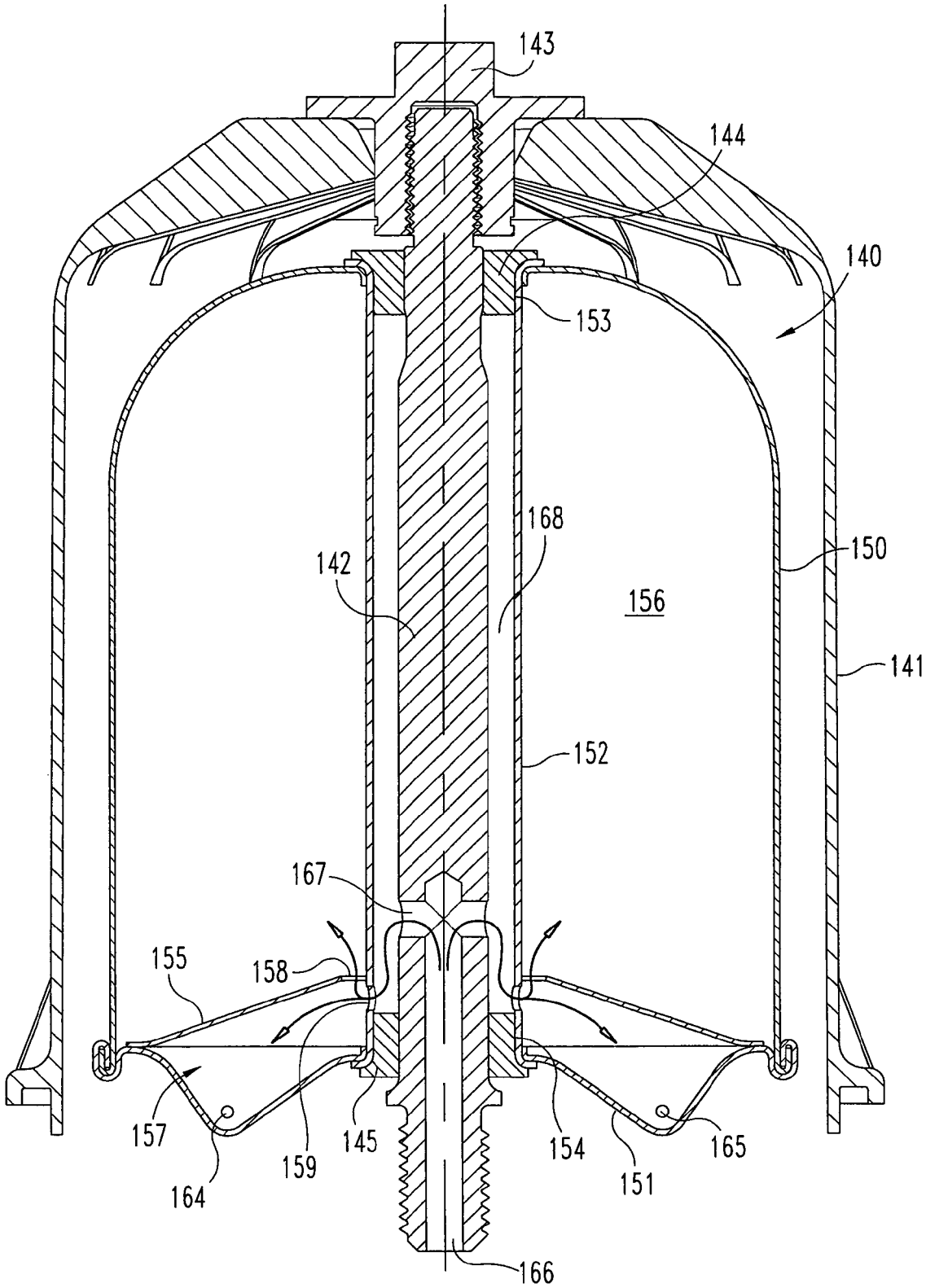
FIG. 14 is a front elevational view, in full section, of a disposable rotor as modified to isolate the collection chamber for a single batch of fluid according to the present invention.

Referring to FIG. 14, there is illustrated a disposable rotor 140, an outer shell 141, shaft 142, collar member 143, upper bushing 144, and lower bushing 145. These components are assembled together to create a centrifuge and, since the focus of the present invention is directed to those components illustrated, the lower portion of the outer centrifuge housing and any base components or other features are not illustrated. More specifically, the focus of the FIG. 14 illustration is directed to the flow paths of incoming fluid (typically oil), and the included structural components have intentionally been left somewhat generic in form. It is the specific structure of these components and their relationship to one another that define the various holes, openings, and passageways for the incoming fluid to be routed as intended by the present invention.

The disposable rotor 140 includes a housing 150 seamed to bottom panel 151 and assembled onto and around centertube 152. The ends 153 and 154 of centertube 152 receive bushings 144 and 145, respectively. Divider plate 155 separates the interior volume of the rotor into a collection chamber 156 and a jet zone 157. The divider plate 155 separates these two volumes so as to create a dead-end design for collection chamber 156. A flow opening 158 is defined by divider plate 155 and its positioning around centertube 152. The only inlet holes 159 in centertube 152 are positioned in the jet zone 157, axially below divider plate 155 and axially below flow opening 158. Bottom panel 151 is shaped and configured so as to define two jet nozzle openings 164 and 165 as part of jet zone 157. Openings 164 and 165 provide for the self-driven rotation of rotor 140. The fluid exiting from opening 164 and 165 creates a Hero turbine that drives the rotor at a rotational rate (spinning) sufficient to separate particulate matter out of the fluid being processed by the centrifuge that includes rotor 140. It will be understood from the FIG. 14 illustration that there are no other inlet holes or flow inlet locations for the collection chamber 156 other than what is provided by flow opening 158. In terms of the present invention, there is this single flow inlet location and it is described as a single inlet, even though there may be a plurality of individual flow openings 158 extending around centertube 152. By having a single fluid flow inlet location for filling collection chamber 156, once that collection chamber is filled with fluid (pressurized), any additional fluid flow that exits out of shaft 142 can only flow through inlet holes 159 and into jet zone 157. With the collection chamber 156 filled with its initial or single charge or batch of fluid, there is no space left for any additional flow to enter through flow opening (openings) 158. While there of course is a second flow inlet into rotor 140, this inlet in terms of inlet holes 159 is below divider plate 155. Accordingly, above divider plate 155 there are no fluid inlet holes leading into the collection chamber 156 other than the defined flow opening 158 which would be considered part of or defined by the divider plate.

In terms of centrifuge efficiency and keeping separated particulate from being disturbed in the collection chamber, the nature of the fluid flow, including the rate, direction and amount, is important. Research and testing on split-flow centrifuge products has proven that the collection rate of ultra-fine particulate (like sub-micron soot in engine oil) can be improved by minimizing the fluid motion caused by flow disturbance in the collection chamber. The ultra-fine particulate can be easily re-entrained from the collected "cake" if there is any significant liquid motion adjacent to the surface of the cake formed from collected and massed particulate. This reduction in fluid motion has been accomplished to some extent by earlier designs by dividing the incoming flow stream into a "drive" flow (majority of total flow) and a much lower "through-rotor" flow. Taken to an extreme, the through-rotor flow can be reduced to zero as now accomplished by the present invention in which case the centrifuge becomes a batch processor of one rotor full of fluid at a time.

The centrifuge rotor 140 is driven by the exiting fluid (Hero turbine) and is designed to operate with an absolute minimal relative fluid motion in the collection chamber by eliminating any flow-through in its entirety. This motion of flowing fluid within the collection chamber can cause re-entrainment of ultra-fine particulate, like the soot found in engine oil. Accordingly, the present invention provides a structure where this flow-through of fluid is eliminated and the collection chamber is actually designed as an isolated "dead end" structure. What occurs is that the incoming fluid flow (oil) fills the rotor with one "rotor-full" of liquid while the system is being pressurized on initial start up and then dumps this single batch of fluid at the time of shut down. This single charge cycling allows the rotor and the corresponding centrifuge to be described as operating as a batch processor. Since there is no flow passing through the collection chamber during operation, effectively any relative motion of the fluid through the collection chamber is eliminated and the collection of ultra-fine particulate can be maximized. The present invention can be described as an extreme case of a split-flow concept where the flow through the collection chamber during operation is reduced to zero. In order to accomplish this result, there are structural modifications and designs that have to be made to the rotor and the rotor's relationship to the remainder of the centrifuge.

With continued reference to FIG. 14, the incoming fluid (oil) enters by way of passageway 166 in shaft 142. Holes 167 communicate with passageway 166 and the incoming fluid flows into annular clearance space 168 and from there through inlet holes 159. While fluid can flow upwardly into the clearance space 168, at some point that space fills with fluid and the path of least resistance is for the flow to travel through inlet holes 159.

The fluid flow through the inlet holes 159 has the option of two directions or paths, at least initially during start up. At this time, incoming fluid can travel through flow opening 158 into the collection chamber or through the jet nozzle openings 164 and 165, or some combination of these two. Due to the smaller opening size of openings 164 and 165 and their throttling effect, the initial path of least resistance is for the incoming fluid at the time of start up to fill the collection chamber 156. As previously noted, the only entrance (and exit) to collection chamber 156 is by way of flow opening (openings) 158. As such, the collection chamber 156 has been described as a "dead-end" chamber. The inlet holes that would normally be in the centertube adjacent the top of the collection chamber are eliminated. This requires that the normal drain, i.e., flow opening 158, be used as the fluid flow inlet into collection chamber 156.

Upon start up, the drilled inlet passageway 166 in shaft 142 is pressurized with fluid and the collection chamber 156 is back filled with fluid through flow opening 158 in divider plate 155 by way of inlet holes 159. Any trapped air in chamber 156 may either be displaced and forced out through any gaps or seams or more likely simply entrained in the fluid and carried out by way of openings 164 and 165. When the fluid pressure remains on, the centrifuge continues to work on removing particulate from the same single batch of fluid (single charge) initially loaded or filled into the collection chamber 156. What occurs at this point with the collection chamber filled with its single batch of fluid, the remaining fluid entering through passageway 166 is routed directly to openings 164 and 165. This then provides the self-driven rotation for rotor 140 in order to separate out particulate matter from the single batch of fluid in collection chamber 156.

When the incoming fluid pressure is shut off, the rotor stops spinning and the single batch of fluid in the collection chamber at that time slowly drains out through the jet openings 164 and 165. The empty collection chamber 156 is then ready to receive a new batch of dirty fluid at the time of the next start up (i.e., pressurizing the centrifuge).

When the collection chamber 156 is filled with fluid as the single batch or charge, the continued delivery of fluid by way of passageway 166 continues the self-driven rotation by exiting through openings 164 and 165. As noted, this flow pattern continues until the centrifuge is shut down and the collection chamber drains.

Figure 15:
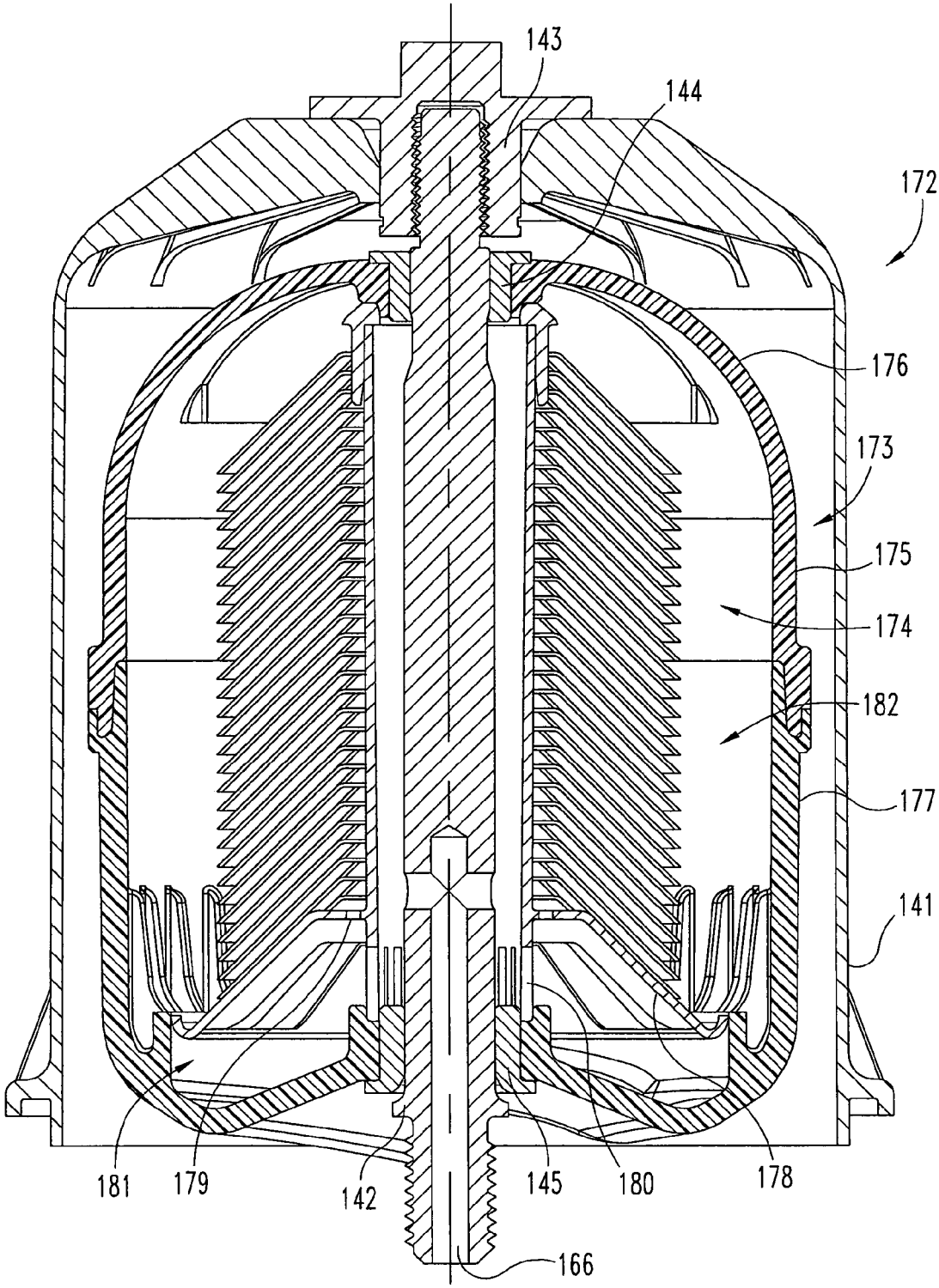
FIG. 15 is a front elevational view, in full section, of a disposable rotor with a cone stack assembly according to the present invention.
Figure 16:
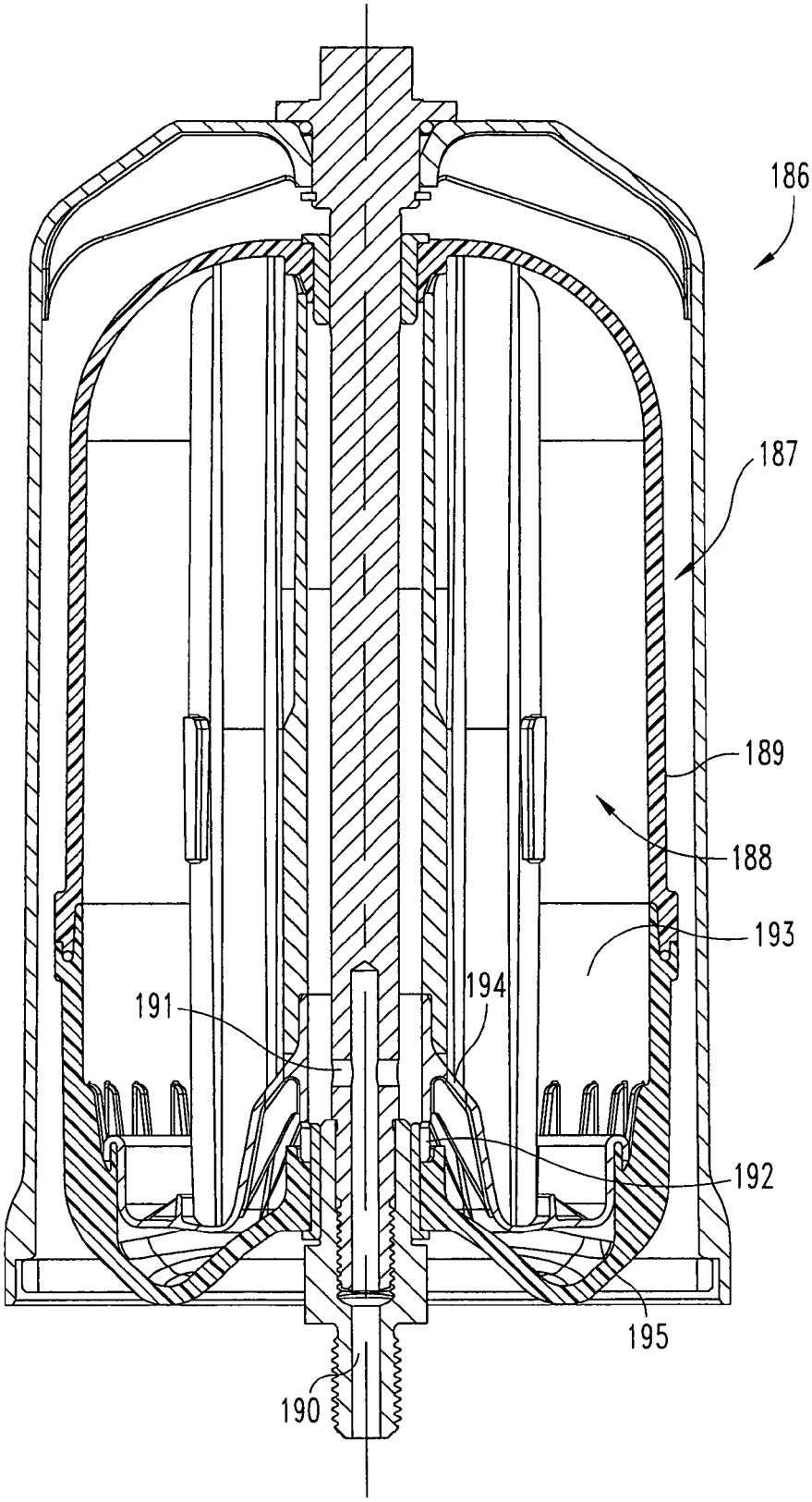
FIG. 16 is a front elevational view, in full section, of a disposable plastic rotor with a spiral vane assembly according to the present invention.

Referring to FIGS. 15 and 16, two additional centrifuge embodiments are illustrated according to the present invention. These two additional centrifuge embodiments are similar in structure and function to what has been described in the context of FIG. 14 with regard to the single batch of fluid and the various flow paths. However, the particulate separation means or mechanism that is part of rotor 140 is different in these two additional embodiments.

Referring first to FIG. 15, centrifuge 172 includes a disposable plastic rotor 173 with a cone stack assembly 174. The housing 150 and bottom panel 151 of rotor 140 are replaced with plastic shell 175 having an upper portion 176 joined to a lower portion 177. Since the outer shell 141, shaft 142, collar member 143, upper bushing 144, and lower bushing 145 of FIG. 15 are virtually identical to these component parts in FIG. 14, the same reference numbers have been used.

The structure of rotor 173 includes a divider plate 178 defining flow opening 179. While not illustrated due to the selected cutting plane for the FIG. 15 illustration, jet nozzle openings are molded into the lower portion 177 of plastic shell 175 for the self-driven rotation of rotor 173. Inlet holes 180 provide the fluid flow path from passageway 166 into jet zone 181 and into collection chamber 182.

Referring now to FIG. 16, the centrifuge 186 construction includes a disposable rotor 187 with a spiral vane assembly 188. Centrifuge 186 is constructed and arranged according to the present invention in terms of the flow paths and the performance consistent with what has been described for rotors 140 and 173. Those descriptions are equally applicable to rotor 187. While the plastic rotor shell 189 has a different configuration from shell 175, its use and configuration in terms of the fluid flow paths is virtually identical to that described for the structures of FIGS. 14 and 15.

With continued reference to the FIG. 16 centrifuge structure, the incoming fluid flow, by way of passageway 190, travels from holes 191 into inlet holes 192. As needed to fill the collection chamber 193, the fluid flow goes through flow opening 194. The flow also travels into the jet zone 195 for the self-driven rotation of the rotor. In FIG. 16, the jet nozzle openings are not illustrated due to the cutting plane selected for the FIG. 16 illustration.

Figure 17:
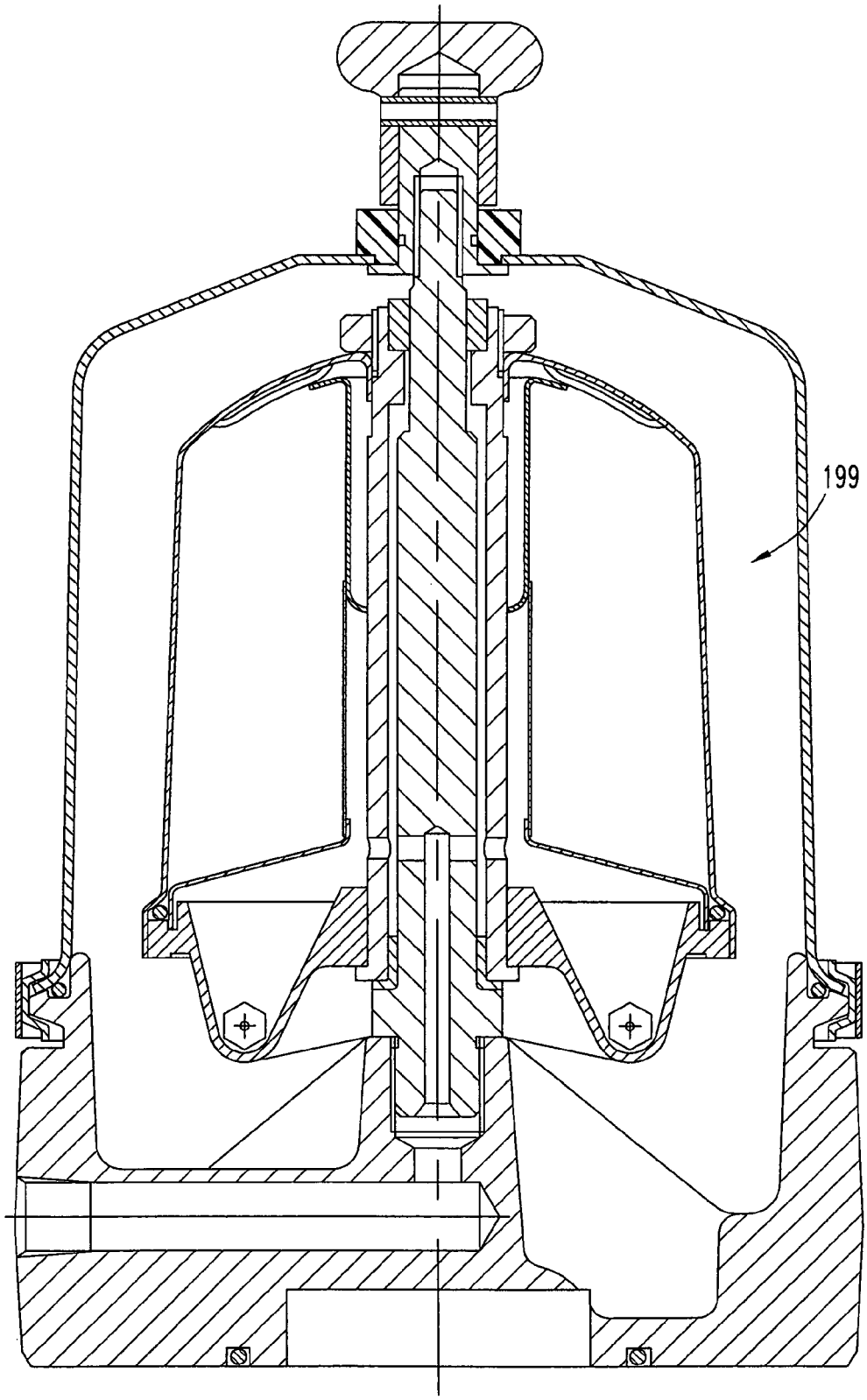
FIG. 17 is a front elevational view, in full section, of a take-apart rotor according to the present invention.
Figure 18:
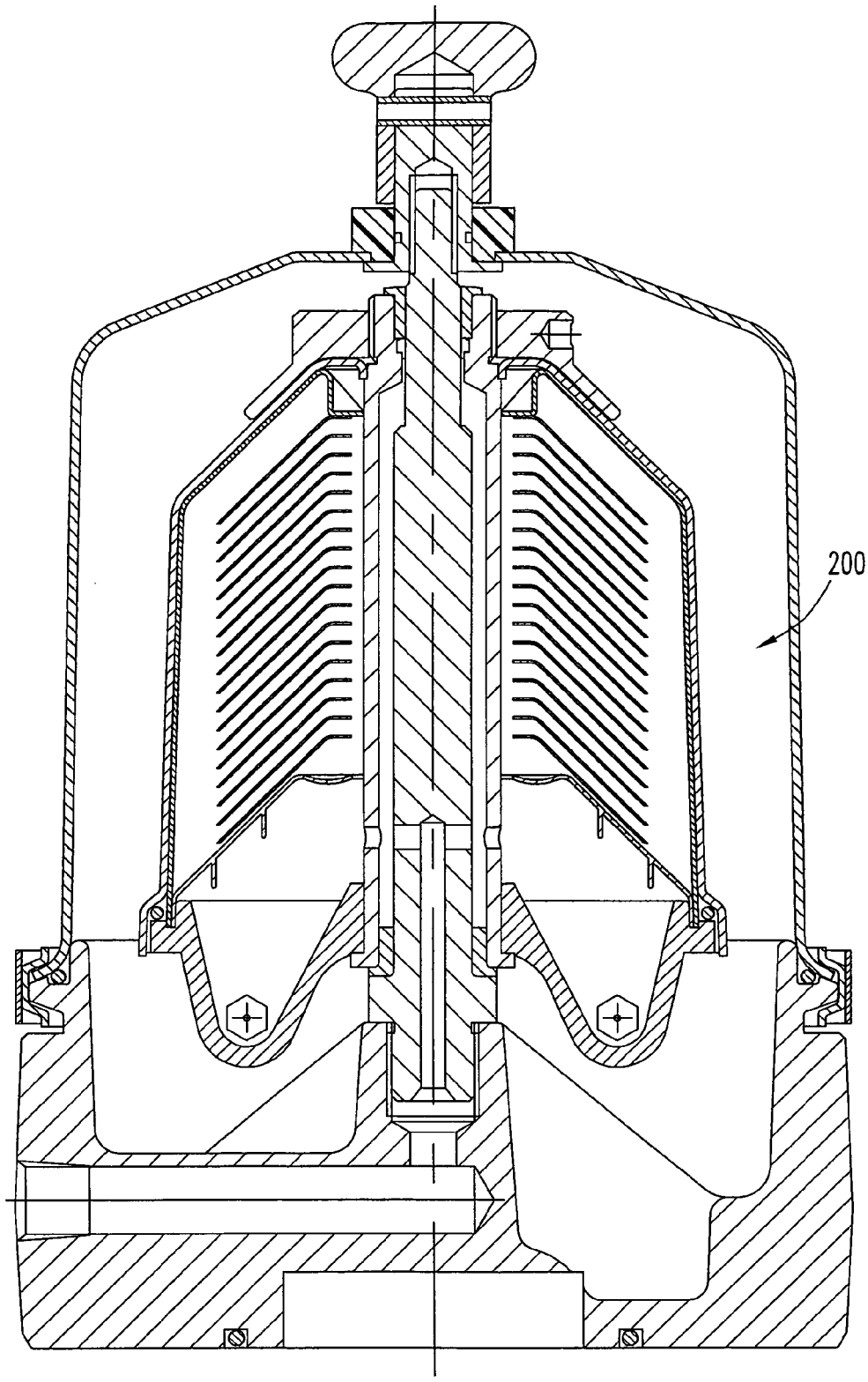
FIG. 18 is a front elevational view, in full section, of a take-apart rotor with a cone stack assembly according to the present invention.

Referring now to FIGS. 17 and 18, the corresponding centrifuge structures are configured as take-apart designs. The illustration of FIG. 17 includes a rotor design similar to FIG. 14. The illustration of FIG. 18 includes a rotor design that includes a cone stack, similar to FIG. 15. Except for the capability of disassembly for cleaning and reuse, as contrasted to a disposable rotor design (see FIGS. 14-16), rotor 199 (FIG. 17) includes all of the flow openings, holes, and passageways of the present invention as described in the context of FIGS. 14-16. The same is true for rotor 200 (FIG. 18) as it includes all of the flow openings, holes, and passageways of the present invention, as described in the context of FIGS. 14-16.

Figure 19:
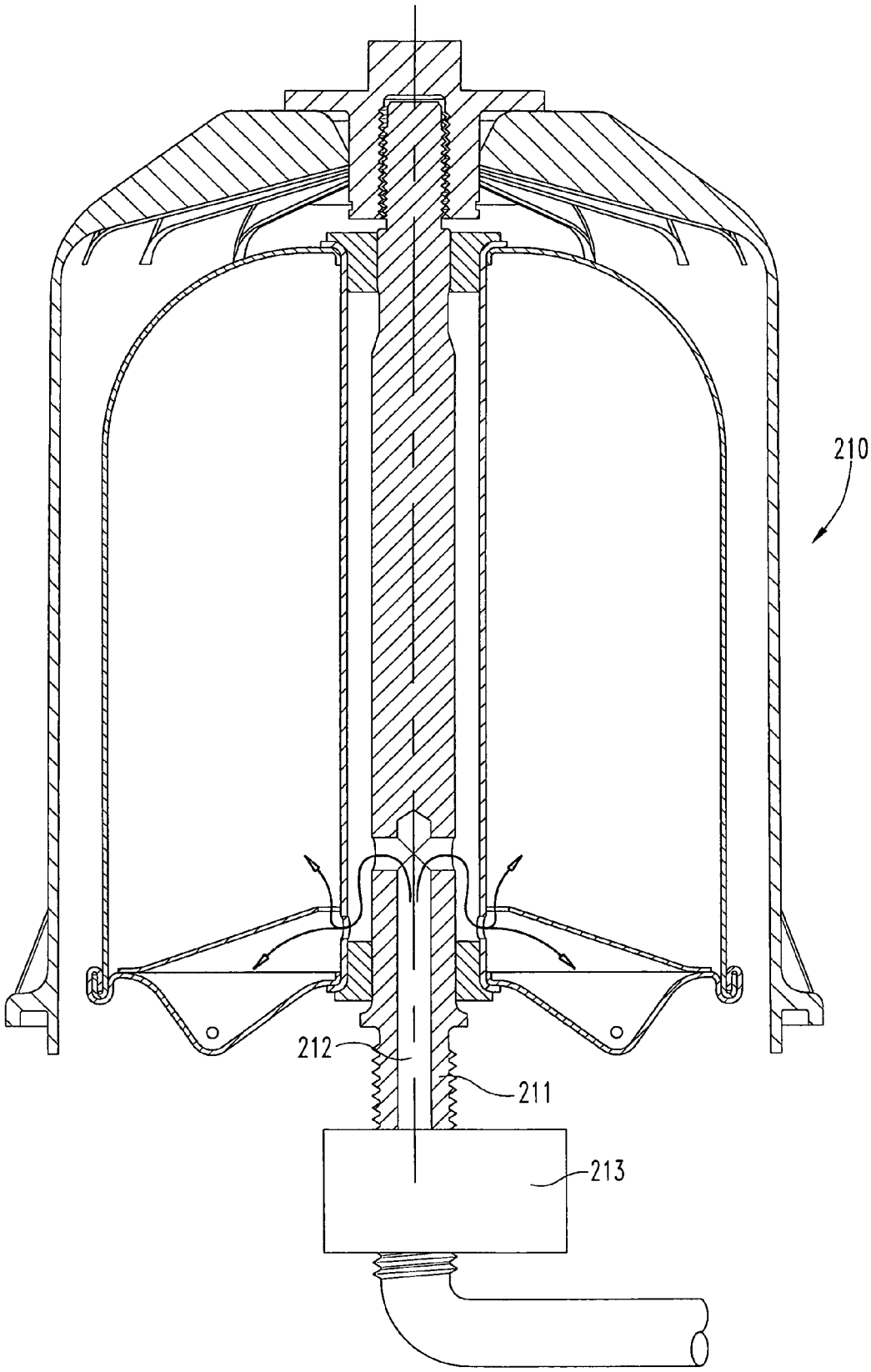
FIG. 19 is a diagrammatic illustration of a centrifuge with a time-actuated shut-off valve connected to the fluid inlet according to the present invention.

There is another consideration of the present invention for those cases, such as with prime-power generators, where the fluid pressure does not shut off for long periods of time. In the context of the present invention, the referenced "long period" is considered to be something greater than twenty (20) to twenty-four (24) hours for a rotor collection chamber of approximately one (1) liter volume. In these situations, it would be advantageous to add a time-actuated shut off valve to the fluid flow inlet so that that incoming fluid flow can be periodically shut off. Once that flow is shut off such that the centrifuge is no longer pressurized, the flow in the collection chamber is allowed to drain so that a new charge of dirty fluid can be introduced. The interval for shut down needs to be long enough for this draining of the collection chamber. This enhancement to the present invention is illustrated in diagrammatic form in FIG. 19. In this illustration, a generic centrifuge 210 with a shaft 211 and passageway 212 is coupled to time-actuated shut off valve 213.

At the end of the predetermined interval when the system is depressurized and shut down for drainage, the system is then pressurized for a new, single batch of dirty fluid for processing by the rotor. It is envisioned that the cyclic frequency of the on and off intervals in terms of pressurizing and then draining the collection chamber can be optimized for the maximum collection rate of the ultra-fine particulate of interest.

Without this periodic drain-refill interval, the same batch of fluid initially loaded into the collection chamber would remain in the rotor for an excessive length of time, reducing the overall collection rate. In this regard, it is to be noted that there is only so much particulate that exists within the single batch of fluid and only so much particulate in terms of size that can be removed from any given rotor-full of fluid.

Figure 20:
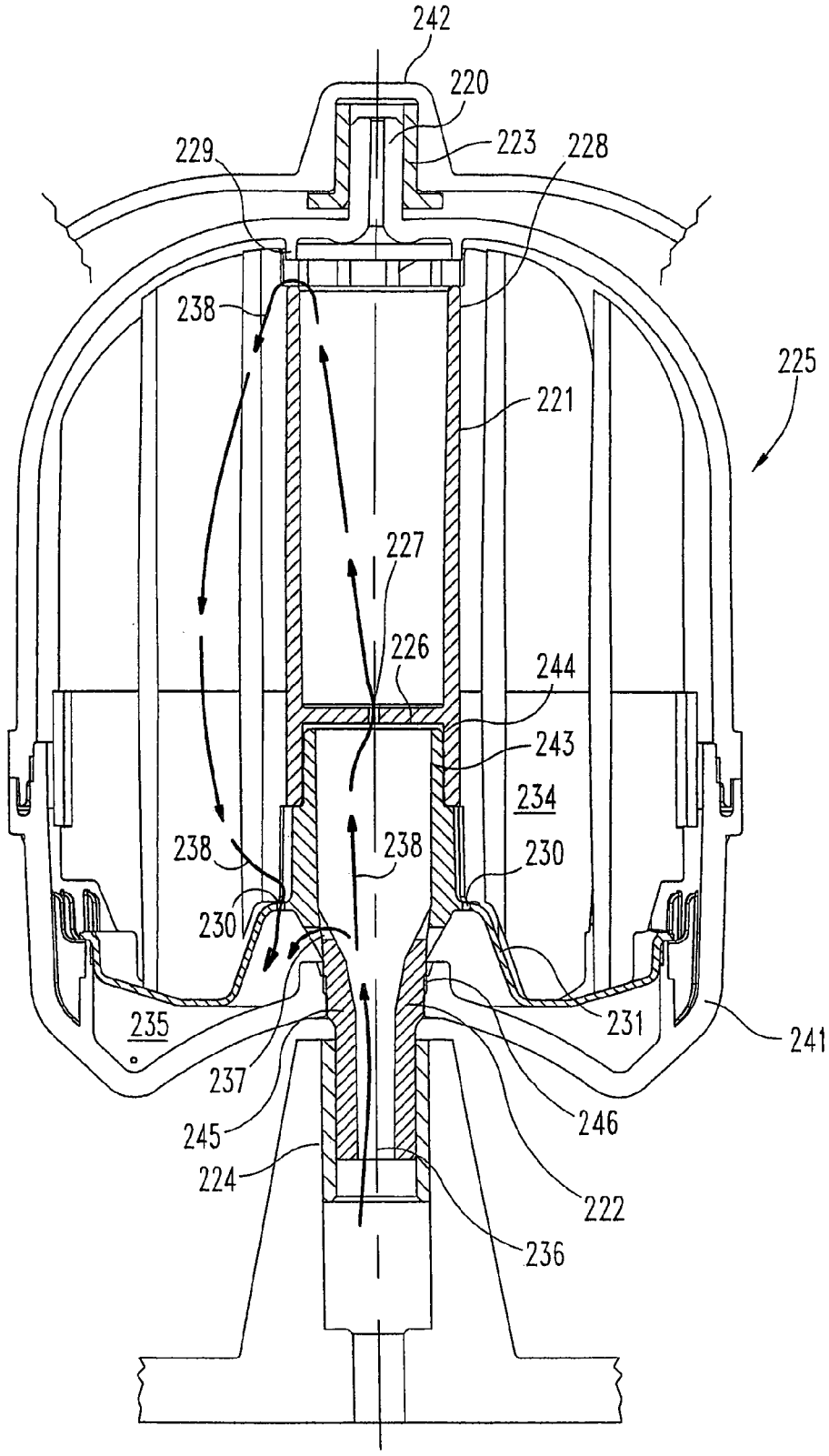
FIG. 20 is a front elevational view, in full section, of a disposable rotor that incorporates a spud-axle in lieu of a shaft.
Figure 21:
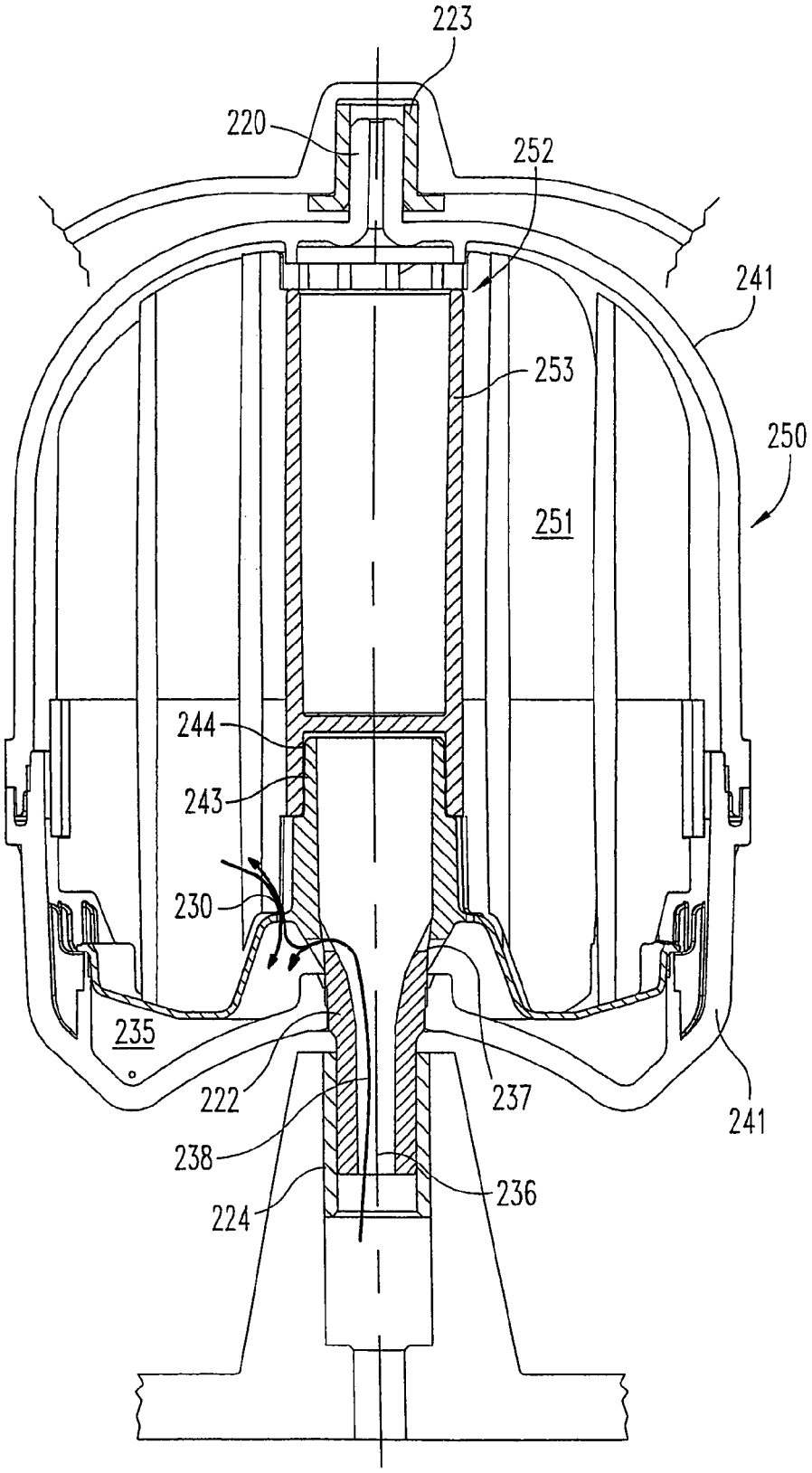
FIG. 21 is a front elevational view, in full section, of a disposable rotor according to another embodiment of the present invention.

Referring to FIGS. 20 and 21, alternative embodiments of a self-driven centrifuge (focusing on the rotor) are illustrated in terms of the interior shaft/spud configuration. The prior embodiments described in the context of FIGS. 1-19 disclose the use of a shaft, such as shaft 46 in FIG. 2 and shaft 142 in FIG. 14, as the corresponding rotational members for the corresponding disposable rotors. Shafts of this type are constructed and arranged to remain stationary relative to rotation of the rotor, such as rotor 140 in FIG. 14.

In FIG. 20, the shaft is replaced by a spud-axle arrangement including an upper axle 220, centertube 221, and spud-axle 222. Top bushing 223 and bottom bushing 224 cooperate for rotary motion of rotor 225. In this embodiment, the centertube 221 includes an interior wall 226 defining a flow opening 227. The upper portion 228 of centertube 221, in cooperation with the upper portion 229 of rotor 225, defines a flow path that enables the flow of fluid through the interior of the rotor (i.e., the collection zone) toward openings 230 that are defined by the divider plate 231 adjacent the base 241 of rotor 225.

Rotor 225 represents the flow path embodiment where there is some measurable flow through the collection zone 234 from the upper portion 229 to openings 230 and, from there, into the jet zone 235. The incoming flow, by way of passageway 236 defined by spud-axle 222, is split such that a portion flows toward the upper portion 228 and the remainder flows by way of opening 237, defined by spud-axle 222, directly into the jet zone 235. The arrows 238 diagrammatically depict these two split-flow paths. The divider plate 231 defines openings 230 for flow from the jet zone into the collection zone relative to the FIG. 21 (single batch) embodiment.

Upper axle 220 is a unitary part of housing 241, noting that the overall two-part housing 241 includes, as a lower portion, the referenced rotor base. Upper axle 220 is received by bushing 223 that in turn is captured by the centrifuge shell 242. The centertube 221 is an integral part of rotor 225. Portion 243 of spud-axle 222 is received by cylindrical bore 244 of centertube 221 with a secure and tight fit. The smaller portion 245 of spud-axle 222 extends through housing opening 246 and is received by bushing 224 that is received within base 247. Portion 245 is securely connected to housing 241 at the location of opening 246 by a spin weld or alternatively by a secure press fit. Spud-axle 222 is hollow and the sidewall of portion 245 defines passageway 236. The transition region between portion 243 and portion 245 defines the exit flow opening 237 for the initial flow into the jet zone 235.

Referring now to FIG. 21, rotor 250 represents another embodiment of the present invention where there is no measurable flow through the collection zone 251. The FIG. 21 rotor 250 corresponds to the single charge or single batch concept described herein. The structure illustrated in FIG. 21 is virtually the same as the structure illustrated in FIG. 20, except that flow opening 227 is eliminated (i.e., closed) and there is no flow path adjacent the upper portion 252 of centertube 253. Most of the reference numbers used in conjunction with FIG. 21 are the same as used in FIG. 20.

One purpose behind including FIGS. 20 and 21 is to clarify that the single charge or single batch structure and concept of the present invention can be achieved and is equally applicable to a rotor/centrifuge design that includes virtually any style of rotational member. In one embodiment of the present invention, this rotational member is configured as a shaft. In another embodiment of the present invention, this rotational member is configured as a spud-axle with a cooperating centertube construction. In terms of the concepts and structures illustrated in FIGS. 20 and 21, it will be understood that the interior of the illustrated rotors in both drawing figures can include a cone stack assembly or alternatively can include a spiral vane assembly. These structures are illustrated in other drawings and it should be clear from those illustrations and disclosures how the spud-axle construction illustrated in FIGS. 20 and 21 can be incorporated into rotor designs including a cone stack assembly or a spiral vane assembly.

The conversion of an existing rotor design to this "batch processor" concept can be performed in a relatively efficient manner and relatively quickly with a minimal tooling cost. What is necessary is to have the various components selected that are structurally compatible with the end result and then modify the component parts so as to eliminate or close off those unnecessary fluid flow passages. By eliminating or closing off any of the unwanted fluid flow passageways, holes, or openings and by selecting the properly designed component parts in terms of the rotor, shaft, divider plate, and housing, the fluid flow paths for the present invention and for this batch processor concept can be achieved.

A similar inventive concept, as disclosed herein, can be employed in an air-driven, electric motor-driven, or pump-driven centrifuge where an electric valve (timer controlled) turns on or off the flow to the collection chamber based on a predetermined cycle. This predetermined cycle can be a set number of hours or could be adjustable by the customer depending on the duty cycle, soot level, etc. The control valve can also be used as the outlet of the collection chamber or used to activate the drain outlet of the collection chamber. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge for batch filtration of a fluid in an engine comprising:

a housing;

a rotational member extending through said housing;

a rotor assembled onto said rotational member and positioned within said housing, said centrifuge being constructed and arranged to enable the self-driven rotation of said rotor by the exit flow of fluid from said rotor;

said rotational member defining a fluid passageway and an exit opening from said rotational member;

said rotor including a divider plate separating said rotor into a batch filtration collection chamber and a jet zone; and said collection chamber having a single fluid entry location defined by said divider plate.

2. The centrifuge of claim 1 wherein said rotor including a centertube extending along an axis and defining at least one axial flow opening located in a fluid path intermediate said rotational member exit opening and said single fluid entry location.

3. The centrifuge of claim 2 which further includes a cone stack assembly.

4. The centrifuge of claim 2 which further includes a spiral vane assembly.

5. The centrifuge of claim 2 wherein said flow opening opens into said jet zone.

6. The centrifuge of claim 2 wherein said rotor is constructed and arranged to be disposable.

7. The centrifuge of claim 1 wherein said rotational member includes a spud-axle and a cooperating centertube, said spud-axle defining said exit opening.

8. The centrifuge of claim 1, which further includes a time-actuated shut off valve for preventing flow into the collection chamber.

9. The centrifuge of claim 1, wherein the single fluid entry location defined by said divider plate is also a single fluid exit location for the collection chamber.

10. A centrifuge for charge cycling of a fluid in an engine comprising:

a housing;

a rotational member defining a flow passageway and extending through said housing;

a rotor assembled onto said rotational member and positioned within said housing, said centrifuge being constructed and arranged to enable the self-driven rotation of said rotor by the exit flow of fluid from said rotor;

said rotor including a dead end collection chamber defining a fluid flow aperture; said rotational member and said rotor cooperatively defining a plurality of flow passages from said flow passageway to said fluid flow aperture;

wherein said rotor has an interior volume and includes a divider plate separating said interior volume into said collection chamber and a jet zone;

wherein said rotational member defines an exit passage in flow communication with said flow passageway; and wherein said fluid flow aperture is the only flow passage into or out of said collection chamber.

11. The centrifuge of claim 10 wherein said rotor includes a centertube defining a flow passage located in a fluid flow path intermediate said rotational member exit passage and said fluid flow aperture.

12. The centrifuge of claim 11 which further includes a cone stack assembly.

13. The centrifuge of claim 11 which further includes a spiral vane assembly.

14. The centrifuge of claim 10, which further includes a time-actuated shut off valve for preventing flow into the collection chamber.

* * * * *